US010876791B2

(12) United States Patent
Valia et al.

(10) Patent No.: US 10,876,791 B2
(45) Date of Patent: Dec. 29, 2020

(54) NAIL LAMP

(71) Applicant: Revlon Consumer Products Organization, New York, NY (US)

(72) Inventors: David Valia, San Diego, CA (US); Thong Vu, Vista, CA (US); Daniel Moore, Escondido, CA (US); Juan Luis Heredia Ferrer, Barcelona (ES); Sergio Garcia Paños, Barcelona (ES); Yin-Jung Lee, Encinitas, CA (US)

(73) Assignee: Revlon Consumer Products Corporation, New York, NY (US)

( * ) Notice: Subject to any disclaimer, the term of this patent is extended or adjusted under 35 U.S.C. 154(b) by 0 days.

(21) Appl. No.: 16/288,840

(22) Filed: Feb. 28, 2019

(65) Prior Publication Data

US 2019/0195558 A1 Jun. 27, 2019

Related U.S. Application Data

(63) Continuation of application No. 15/109,503, filed as application No. PCT/US2015/053449 on Oct. 1, 2015, now Pat. No. 10,247,475.

(Continued)

(51) Int. Cl.
*F26B 9/00* (2006.01)
*F26B 3/28* (2006.01)

(Continued)

(52) U.S. Cl.
CPC ..... *F26B 9/003* (2013.01); *A45D 29/00* (2013.01); *A45D 29/22* (2013.01); *F26B 3/28* (2013.01); *A45D 2200/205* (2013.01)

(58) Field of Classification Search
CPC .... F26B 9/00; F26B 9/003; F26B 3/00; F26B 3/28; F26B 29/00; F26B 29/22; F26B 2200/205

(Continued)

(56) References Cited

U.S. PATENT DOCUMENTS 300,960 A ‡ 6/1884 Day
431,682 A ‡ 7/1890 Alley (Continued)

FOREIGN PATENT DOCUMENTS

CA 2340209 A1 9/2002
CA 2340209 A1 ‡ 9/2002 ..... A41D 13/087

(Continued)

OTHER PUBLICATIONS

International Search Report Issued in PCT/US2013/034625.

(Continued)

*Primary Examiner* — Stephen M Gravini

(74) *Attorney, Agent, or Firm* — Reylon Consumer Products Corp; Leonard Rosenfeld

(57) ABSTRACT

A nail lamp is configured to cure light-curable nail product on a user's nail. The lamp includes a base and a support with discrete light sources that each may emit with the same or different light wavelength profiles, and each may emit continuously or with the same or different pulsing functions. The lamp also includes source reflectors and a ring reflector. The different wavelength profiles are configured to, in combination, cure a light-curable nail product. The pulsing function is used to cure the nail product more efficiently. The source reflectors and ring reflector are used to target specific areas of the nail. A space is disposed between the base and the support and is sized to accommodate therein the nails of an appendage of a user so as to expose the user's nails to light from the discrete light sources.

17 Claims, 33 Drawing Sheets

Related U.S. Application Data

(60) Provisional application No. 62/058,865, filed on Oct. 2, 2014, provisional application No. 62/059,585, filed on Oct. 3, 2014.

(51) Int. Cl.
*A45D 29/22* (2006.01)
*A45D 29/00* (2006.01)

(58) Field of Classification Search
USPC ..... 34/275
See application file for complete search history.

(56) References Cited

U.S. PATENT DOCUMENTS 489,489 A ‡ 1/1893 Miller
492,447 A ‡ 2/1893 Villard
2,218,296 A ‡ 10/1940 Juliette ..... A45D 29/00 132/73
2,262,274 A 11/1941 Fingerlin
2,262,774 A ‡ 11/1941 Fingerlin
3,179,795 A ‡ 4/1965 Angle ..... A45D 29/00 362/103
3,864,847 A * 2/1975 Friedman ..... A45D 29/18 34/202
3,884,847 A ‡ 5/1975 Pruvost
4,193,209 A * 3/1980 Lovison ..... A45D 29/18 34/202
4,754,769 A ‡ 7/1988 Flynn
D300,960 S * 5/1989 Billings ..... D28/58
4,967,775 A ‡ 11/1990 Kaiser
4,979,523 A ‡ 12/1990 Grimm ..... A45D 29/18 132/73
5,084,984 A ‡ 2/1992 Duchoud
5,103,845 A ‡ 4/1992 Matthews ..... A45D 29/00 132/73
5,249,367 A ‡ 10/1993 Nafziger ..... A45D 29/18 34/202
5,336,128 A ‡ 8/1994 Birdsong ..... A45D 29/00 454/56
5,515,621 A ‡ 5/1996 Bloom ..... A45D 29/18 34/202
D431,682 S * 10/2000 Seo ..... D28/54.1
D453,858 S ‡ 2/2002 Tsai ..... D28/54
6,518,583 B1 2/2003 Hennig
6,618,683 B1 2/2003 Hennig
D487,489 S ‡ 3/2004 Bae ..... D28/54
D489,489 S * 5/2004 Khalaj ..... D28/54.1
D492,447 S * 6/2004 Mills ..... D28/54.1
6,826,848 B1 ‡ 12/2004 Delaney ..... A45D 29/00 34/202
7,118,589 B2 10/2006 Vlahos
7,712,473 B1 ‡ 5/2010 Robinson ..... A45D 29/00 132/73
D661,021 S ‡ 5/2012 Chang ..... D28/54
D661,429 S ‡ 6/2012 Huthmaker ..... D24/19
8,242,475 B1 ‡ 8/2012 Cheng ..... A45D 29/00 118/62
8,286,643 B2 10/2012 Li
8,312,641 B2 ‡ 11/2012 Li ..... F26B 3/28 118/642
8,450,705 B1 ‡ 5/2013 Chen ..... F26B 3/28 250/49
8,696,161 B2 ‡ 4/2014 Pan ..... A45D 29/00 257/10
8,835,886 B2 ‡ 9/2014 Vu ..... A45D 29/00 250/494.1
1,491,106 A1 10/2015 Park
9,149,106 B2 ‡ 10/2015 Park ..... A45D 31/00
9,713,371 B1 ‡ 7/2017 Luu ..... A45D 29/00
9,841,233 B2 ‡ 12/2017 Valia ..... F26B 3/347
10,393,433 B2 * 8/2019 Valia ..... A45D 29/18
10,506,861 B1 * 12/2019 Ma ..... A45D 29/00
2002/0181947 A1 ‡ 12/2002 Cao ..... A61C 19/004 392/40
2006/0260628 A1 ‡ 11/2006 Chan ..... A45D 29/00 132/73
2009/0143842 A1 * 6/2009 Cumbie ..... A61N 5/0624 607/88
2010/0293805 A1 ‡ 11/2010 Chang
2011/0277338 A1 ‡ 11/2011 Li ..... F26B 3/28 34/275
2012/0187311 A1 ‡ 7/2012 Vu ..... A45D 29/00 250/49
2013/0013444 A1 ‡ 1/2013 Vandikas ..... G06Q 10/00 705/26
2013/0109001 A1 5/2013 Pan et al.
2013/0161531 A1 ‡ 6/2013 Haile ..... A45D 29/00 250/45
2013/0255100 A1 ‡ 10/2013 Valia ..... F26B 3/347 34/275
2014/0124655 A1 ‡ 5/2014 Rivero ..... A45D 29/00 250/20
2014/0168972 A1 ‡ 6/2014 Ebner ..... F21V 5/007 362/23
2014/0194955 A1 7/2014 Povolosky et al.
2016/0370113 A1 ‡ 12/2016 Valia ..... A45D 29/00
2017/0343282 A1 ‡ 11/2017 Valia ..... A45D 29/18
2017/0354235 A1 ‡ 12/2017 Miller ..... A45D 34/045
2019/0195558 A1 6/2019 Valia et al.

FOREIGN PATENT DOCUMENTS

CN 201227850 Y ‡ 4/2009
CN 201227850 Y 4/2009
CN 102935422 2/2013
CN 102935422 A ‡ 2/2013
CN 102935422 A 2/2013
CN 202778914 3/2013
CN 202778914 A ‡ 3/2013
CN 202778914 U 3/2013
CN 103596464 2/2014
CN 103596464 A 2/2014
CN 103596464 A ‡ 2/2014 ..... A45D 29/00
CN 203801932 9/2014
CN 203801932 U ‡ 9/2014
CN 203801932 U 9/2014
DE 202004008982 U1 8/2004
DE 202006005790 U1 6/2006
JP 2011-98073 A 5/2011
JP 2011098073 A ‡ 5/2011 ..... A45D 29/00
RU 90301 U1 1/2010
RU 90301 U1 10/2010
TW M424054 3/2012
TW M424054 U ‡ 3/2012
WO 2005068509 A1 7/2005
WO 2005120286 A1 12/2005
WO WO 2005/120286 A1 ‡ 12/2005
WO 2007115666 A1 10/2007
WO WO 2007/115666 A1 ‡ 10/2007
WO WO2007115666 A1 10/2007
WO WO 2007115666 A1 ‡ 10/2007 ..... A45D 29/00
WO WO-2013149156 A3 * 10/2013

OTHER PUBLICATIONS

International Search Authority, Federal Service on Intellectual Property, "Search Report for PCT/US2015/053449", "Foreign Counterpart to U.S. Appl. No. 15/109,503", 2019, pp. 1-2, Published: RU.

* cited by examiner
‡ imported from a related application

NAIL LAMP

CROSS REFERENCE TO RELATED APPLICATIONS

This application is a continuation of co-pending U.S. application Ser. No. 15/109,503, which was filed on Jul. 1, 2016 and claims the benefit of U.S. Provisional Application No. 62/059,585 filed on Oct. 3, 2014 and U.S. Provisional Application No. 62/058,865 filed on Oct. 2, 2014.

BACKGROUND OF THE INVENTION

Field of the Invention

The present invention is generally related to a light-curing nail lamp, which has a light source designed to cure a light-curable nail product on a user's nails.

Related Art

Conventional nail coatings may be classified into two categories: nail polishes (e.g., lacquers, varnish or enamels), and artificial nails (e.g., gels or acrylics). Nail polishes typically comprise various solid components, which are dissolved and/or suspended in non-reactive solvents. Upon application and drying, the solids deposit on the nail surface as a clear, translucent, or colored film. Typically, nail polishes are easily scratched and are easily removable with solvent, usually within one minute and if not removed as described, will chip or peel from the natural nail in one to five days.

Conventional artificial nails are comprised of chemically reactive monomers, and/or oligomers, and photoinitiators in combination with non-reactive polymers to create systems that are typically 100% solids and do not require non-reactive solvents. The photoinitiators respond differently depending on a light source's intensity and wavelength. The photoinitiators react with light to form radical photoinitiators, which in turn, react with the ingredients listed above to form a nail coating. A mixture with more photoinitiators requires a lower intensity to properly cure the mixture, while a mixture with more colorant(s), which block light from penetrating through the coating, requires a higher intensity to properly cure the mixture. Additionally, higher wavelengths of emitted light are better for bulk curing, while lower wavelengths of emitted light are better for surface curing.

Upon pre-mixing and subsequent application to the nail plate, or application and exposure to light (e.g., UV, actinic radiation, other light within or outside the visible spectrum), a chemical reaction ensues resulting in the formation of a long lasting, highly durable cross-linked thermoset nail coating that is difficult to remove. Artificial nails may possess greatly enhanced adhesion, durability, scratch resistance, and solvent resistance when compared to nail polishes.

After applying a light curable nail product (e.g., gel or acrylic) to a user's nails (e.g., finger nails, toe nails), the user places one or more of their nails under a nail lamp. The nail lamp emits light that cures the light-curable nail product, providing a durable nail product.

BRIEF DESCRIPTION

One or more embodiments of the present invention provide a nail lamp with improved light-curing characteristics (e.g., faster curing times, more consistent curing at a single nail and/or across a plurality of nails on a user's appendage), improved bulb positioning, an open architecture that permits the user's hands/feet to remain substantially visible and exposed to the ambient environment, a compact stowable size, reduced power consumption, and/or reduced heat generation.

One or more embodiments of the present invention provide a portable, easily carried nail lamp.

One or more embodiments of the present invention provide a nail lamp that focuses curing light on the user's nails while limiting the user's skin exposure to such light.

One or more embodiments of the present invention provide a nail lamp that includes: an array of discrete light sources, wherein at least one of the discrete light sources has a different light wavelength profile than at least one other of the discrete light sources, wherein the different wavelength profiles are configured to cure a light-curable nail product; and a space disposed beneath the array, the space being sized to accommodate therein at least one nail on an appendage of a user. The array of discrete light sources is positioned relative to the space so as to expose the at least one nail to light from the at least one of the discrete light sources and from the at least one other of the discrete light sources.

According to one or more of these embodiments, the light wavelength profile of the at least one of the discrete light sources has a maximum intensity at a wavelength less than 475 nm, and the light wavelength profile of the at least one other of the discrete light sources has a maximum intensity at a wavelength less than 475 nm.

According to one or more of these embodiments, the space is sized to accommodate therein a plurality of nails on the appendage of the user, the array includes a plurality of clusters of the discrete light sources, and each of a plurality of the plurality of clusters includes at least two discrete light sources that have different light wavelength profiles than each other.

According to one or more of these embodiments, the space is sized to accommodate therein all five nails on a hand of the user. The plurality of clusters includes a first cluster that is positioned to direct light from the first cluster's light sources to a nail of a middle finger of the user. The plurality of clusters also includes a second cluster and a third cluster disposed on left and right sides, respectively, of the first cluster. The second and third clusters are positioned to direct light from their respective light sources to nails on the index and ring fingers, respectively, of the user depending on whether the user's right or left hand is disposed in the space. The plurality of clusters also includes a fourth cluster disposed to the left of the second cluster, and a fifth cluster disposed to the right of the third cluster.

According to one or more of these embodiments, the fourth cluster is positioned to direct light from the fourth cluster's light sources to a nail of a pinky finger of the user's left hand, and the fifth cluster is positioned to direct light from the fifth cluster's light sources to a nail of a thumb of the user's left hand. The plurality of clusters includes a sixth cluster disposed to the left of the second cluster and positioned to direct light from the sixth cluster's light sources to a nail of a thumb of the user's right hand, and a seventh cluster disposed to the right of the third cluster and positioned to direct light from the seventh cluster's light sources to a nail of a pinky of the user's right hand.

According to one or more of these embodiments, the lamp also includes a controller having left hand and right hand states. The left hand state is a state that is configured to deliver power to the first through fifth clusters of light sources, but not the sixth or seventh clusters of light sources. The right hand state is a state configured to deliver power to the first through third, sixth, and seventh clusters of light sources, but not the fourth or fifth clusters of light sources.

According to one or more of these embodiments, the space is sized to accommodate therein a plurality of nails on the appendage of the user. The array of discrete light sources is arranged in a U shaped pattern.

According to one or more of these embodiments, the discrete light sources include at least a first plurality of discrete light sources that each have a first light wavelength profile, and a second plurality of discrete light sources that each have a second light wavelength profile. The first light wavelength profile is different than the second light wavelength profile.

According to one or more of these embodiments, the space is sized to accommodate therein a plurality of nails on the appendage of the user. The first and second pluralities of discrete light sources are arranged to expose each of the plurality of nails to light from at least one of said first plurality of discrete light sources and from at least one of said second plurality of discrete light sources.

According to one or more of these embodiments, the array includes a plurality of clusters of said discrete light sources. Each of a plurality of said plurality of clusters can include at least one of said first plurality of discrete light sources, and at least one of said second plurality of discrete light sources.

According to one or more of these embodiments, the first light wavelength profile has a maximum intensity at a wavelength less than or equal to 400 nm, and the second light wavelength profile has a maximum intensity at a wavelength greater than or equal to 400 nm.

According to one or more of these embodiments, the discrete light sources include a third plurality of discrete light sources that each have a third light wavelength profile. Each of a plurality of the plurality of clusters includes at least one of the third plurality of discrete light sources. The third light wavelength profile has a maximum intensity at a wavelength that is greater than 385 nm and less than 425 nm.

According to one or more of these embodiments, the space is sized to accommodate therein a plurality of nails on the appendage of the user. The array of discrete light sources is arranged to expose each of the plurality of nails to light from a respective set of at least two of the discrete light sources. Each respective set of at least two of the discrete light sources contains discrete light sources with different light wavelength profiles than each other.

According to one or more of these embodiments, the plurality of nails is the five nails on the appendage of the user.

According to one or more of these embodiments, each of the discrete light sources is a light emitting diode.

According to one or more of these embodiments, the space is substantially open to an ambient environment to the front, rear, left, and right of the space.

According to one or more of these embodiments, the space is sized to simultaneously accommodate therein all ten nails on two appendages of a user. The array of discrete light sources is positioned relative to the space so as to expose the ten nails to light from the array.

One or more embodiments of the present invention provide a method of curing light-curable nail product using a nail lamp comprising an array of discrete light sources and a space disposed beneath the array. The method includes receiving at least one nail of a digit of an appendage of a human user in the space. The at least one nail has thereon uncured light-curable nail product. The method also includes exposing the light-curable nail product to light from a first one of the discrete light sources and light from a second one of the discrete light sources. The light from the first one of the discrete light sources has a different light wavelength profile than the light from the second one of the discrete light sources. The exposing light-cures the nail product.

According to one or more of these embodiments, the light from the first one of the discrete light sources and the light from the second one of the discrete light sources both contribute to said light-curing of the nail product.

According to one or more of these embodiments, the exposing light-cures the nail product in less than 10 minutes.

According to one or more of these embodiments, the light from the first one of the discrete light sources has a maximum intensity at a wavelength less than 475 nm, and the light from the second one of the discrete light sources has a maximum intensity at a wavelength less than 475 nm.

One or more embodiments of the present invention provide a nail lamp comprising: a support having an operative position; a space disposed beneath the support when the support is in its operative position, the space being sized to accommodate therein at least four nails on an appendage of a user; and an array of one or more light sources supported by the support and configured to produce light that is configured to cure a light-curable nail product. The array of one or more light sources is positioned to direct the light onto the at least four nails when the user's appendage is in the space. When the support is in the operative position, the space is substantially open to an ambient environment to the front and rear of the space.

According to one or more of these embodiments, when the support is in the operative position, the space is substantially open to the ambient environment to the left and right of the space.

According to one or more of these embodiments, the at least four nails on the appendage of the user includes all five nails on the appendage of the user.

According to one or more of these embodiments, the support is U-shaped, and the space is substantially open to the ambient environment above the space except for the support.

According to one or more of these embodiments, the lamp also includes a base. The support is connected to the base for movement relative to the base between the operative position and a stowed position.

One or more embodiments of the present invention provide a method of curing light-curable nail product using a nail lamp that includes a support, an array of one or more light sources connected to the support, and a space disposed beneath the array, the space being substantially open to an ambient environment to the front and rear of the space. The method includes receiving at least four nails on an appendage of a user in the space. The at least four nails have thereon uncured light-curable nail product. The method also includes exposing the light-curable nail product to light from the array of one or more light sources. Said exposing to light cures the nail product on the at least four nails.

According to one or more of these embodiments, the space is substantially open to the ambient environment to the left and right of the space.

According to one or more of these embodiments, the at least four nails include thumb, index, middle, ring, and pinky nails on a hand of the user. After the receipt of the thumb, index, middle, ring, and pinky nails, the index, middle, ring, and pinky nails are visible from a front of the nail lamp.

According to one or more of these embodiments, the support is a U-shaped, and the space is substantially open to the ambient environment above the space except for the support.

According to one or more of these embodiments, the nail lamp includes a base, and the support is connected to the base for movement relative to the base between an operative position that provides the space and a stowed position.

According to one or more of these embodiments, the base forms a platform configured to support the user's appendage. The platform defines a bottom of the space when the support is in the operative position.

According to one or more of these embodiments, the support is pivotally connected to the base for movement relative to the base between the operative and stowed positions.

One or more embodiments of the present invention provide a nail lamp that includes: a first housing portion; a second housing portion connected to the first housing portion for movement relative to the first housing portion between an operative position and a stowed position; a space disposed between the housing portions when the second housing portion is in its operative position, the space being sized to accommodate therein at least one nail on an appendage of a user; and an array of one or more light sources supported by the second housing portion and configured to produce light that is configured to cure a light-curable nail product. When the second housing portion is in the operative position and the user's at least one nail is in the space, the array of one or more light sources is positioned to direct the light onto the at least one nail.

According to one or more of these embodiments, when the second housing portion is in the operative position, the space is substantially open to an ambient environment to the front and rear of the space.

According to one or more of these embodiments, the space is sized to accommodate therein all five nails on the appendage of the user. When the second housing portion is in the operative position and the user's appendage is in the space, the array of one or more light sources is positioned to direct the light onto the five nails.

According to one or more of these embodiments, the first housing portion includes a platform that is configured to support at least a portion of the user's appendage. The platform defines a bottom of the space when the second housing portion is in the operative position.

According to one or more of these embodiments, the second housing portion pivotally connects to the first housing portion for movement relative to the first housing portion between the operative and stowed positions.

According to one or more of these embodiments, the nail lamp is more compact when the second housing portion is in the stowed position than when the second housing portion is in the operative position.

According to one or more of these embodiments, the second housing portion and first housing portion enclose the array of one or more light sources when the second housing portion is in the stowed position.

One or more embodiments of the present invention provide a method of curing light-curable nail product using a nail lamp that has a first housing portion, a second housing portion connected to the first housing portion for movement relative to the first housing portion between an operative position and a stowed position, a space disposed between the housing portions when the second housing portion is in its operative position, and an array of one or more light sources supported by the second housing portion and configured to produce light that is configured to cure a light-curable nail product. The method includes positioning the second housing portion in the operative position. The method also includes receiving at least one nail on an appendage of a user in the space, the at least one nail having thereon uncured light-curable nail product. The method further includes exposing the light-curable nail product to light from the array of one or more light sources. The exposing to light cures the nail product on the at least one nail.

According to one or more of these embodiments, the at least one nail includes all five nails on an appendage of the user. The method includes receiving the five nails in the space, each of the five nails having thereon uncured light-curable nail product. The method further includes exposing the light-curable nail product on each of the five nails to light from the array of one or more light sources. The exposing to light cures the nail product on each of the five nails.

One or more embodiments provide a reflector connected to a top surface of the base of the nail lamp. The reflector is arranged in an arc-shape between a left portion of the base and the right portion of the base. The reflector may include a wall portion and/or a base portion, in which the wall portion may be substantially perpendicular to the base portion or may be at an angle exceeding 90° relative to the base portion.

One or more embodiments provide source reflectors arranged within the support around each of the light sources. The source reflector has a small end and a large end, and each of these ends may have an opening shaped as an oval, a circle, a square, a rectangle, or any other shape. The source reflector(s) is structured to direct light from the light source(s) onto a corresponding nail within the space.

According to one or more embodiments, the light source(s) may be a single wavelength LED device or may be a multiple-wavelength LED device. The LED device includes a circuit board with a plurality of semiconductor chips coupled thereto, and may include a protective lens to cover the circuit board. These chips may be of the same wavelength or may be of different wavelengths.

According to one or more embodiments, the LED device may be pulsed. The LED may be pulsed between an off state and a peak intensity on state, between an off state and an intermediate intensity on state, between an intermediate intensity on state and a peak intensity on state, or between two intermediate intensities at an on state. The pulsing may be performed according to pulsing sequences of varying intensities and varying time durations.

One or more embodiments provide a controller that may control the intensity of the LED device and/or control the pulsing sequence of the LED device. The controller may include a controller interface connected to control buttons, a control dial, a digital input pad, and the like, located on the nail lamp.

These and other aspects of various embodiments of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. In addition, it should be appreciated that structural features shown or described in any one embodiment herein can be used in other embodiments as well. As used in the specification and in the claims, the singular form of "a," "an," and "the" include plural referents unless the context clearly dictates otherwise.

BRIEF DESCRIPTION OF THE DRAWINGS

For a better understanding of the embodiments of the present invention, as well as other objects and further features thereof, reference is made to the following description, which is to be used in conjunction with the accompanying drawings, where.

DETAILED DESCRIPTION

Figure 1:
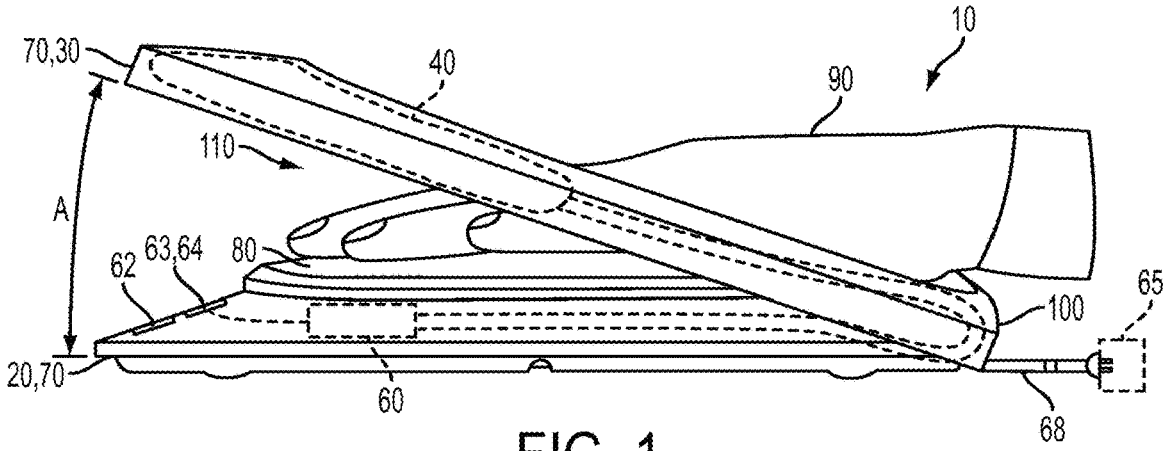
FIG. 1 is a left side view of a nail lamp according to an embodiment of the present invention.

FIGS. 1-6 illustrate a nail lamp 10 according to an embodiment of the present invention. The lamp 10 includes a base 20, a support 30 movably mounted to the base 20, an array 40 of discrete light sources 50 supported by the support 30 (FIG. 6), and a controller 60 (FIG. 1).

Figure 2:
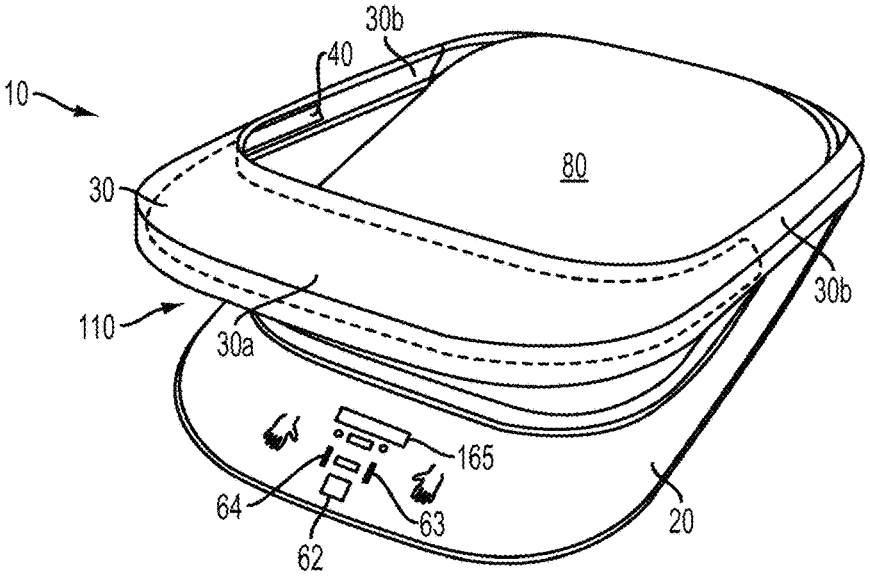
FIG. 2 is a left perspective view of the nail lamp of FIG. 1.

As used herein, the front of the lamp 10 means the direction toward which a user's digits extend during use (to the left as shown in FIG. 1, toward the bottom as shown in FIG. 2). Conversely, the rear of the lamp 10 is an opposite side to the front (to the right as shown in FIG. 1, toward the top as shown in FIG. 2). The left side of the lamp 10 extends out of the page in FIG. 1, and the right side of the lamp 10 extends into the page in FIG. 1. The top of the lamp 10 extends upwardly in FIG. 1 and the bottom of the lamp conversely extends downwardly in FIG. 1.

As shown in FIGS. 1-5, the base 20 (e.g., a first housing portion) and support 30 (e.g., a second housing portion) together define a housing 70 of the lamp 10.

As shown in FIGS. 1-5, the base 20 is adapted to lay on and be supported by a horizontal surface such as a table top. The base 20 includes a platform 80 that is configured to support a user's appendage 90 (i.e., a hand or a foot).

Figure 3:
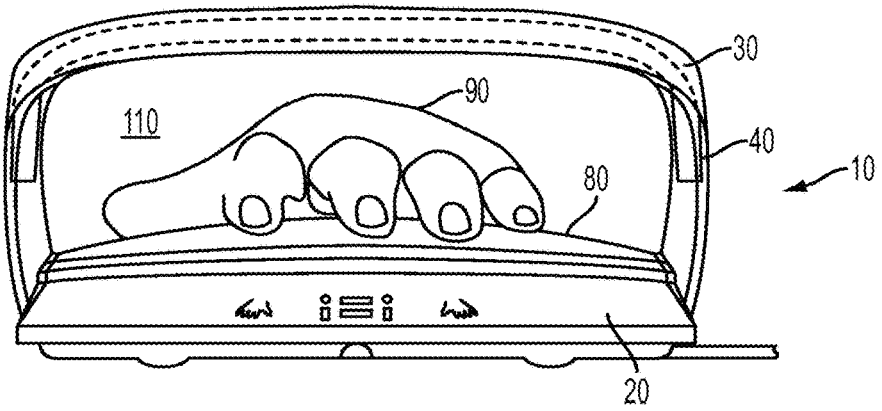
FIG. 3 is a front view of the nail lamp of FIG. 1.
Figure 4:
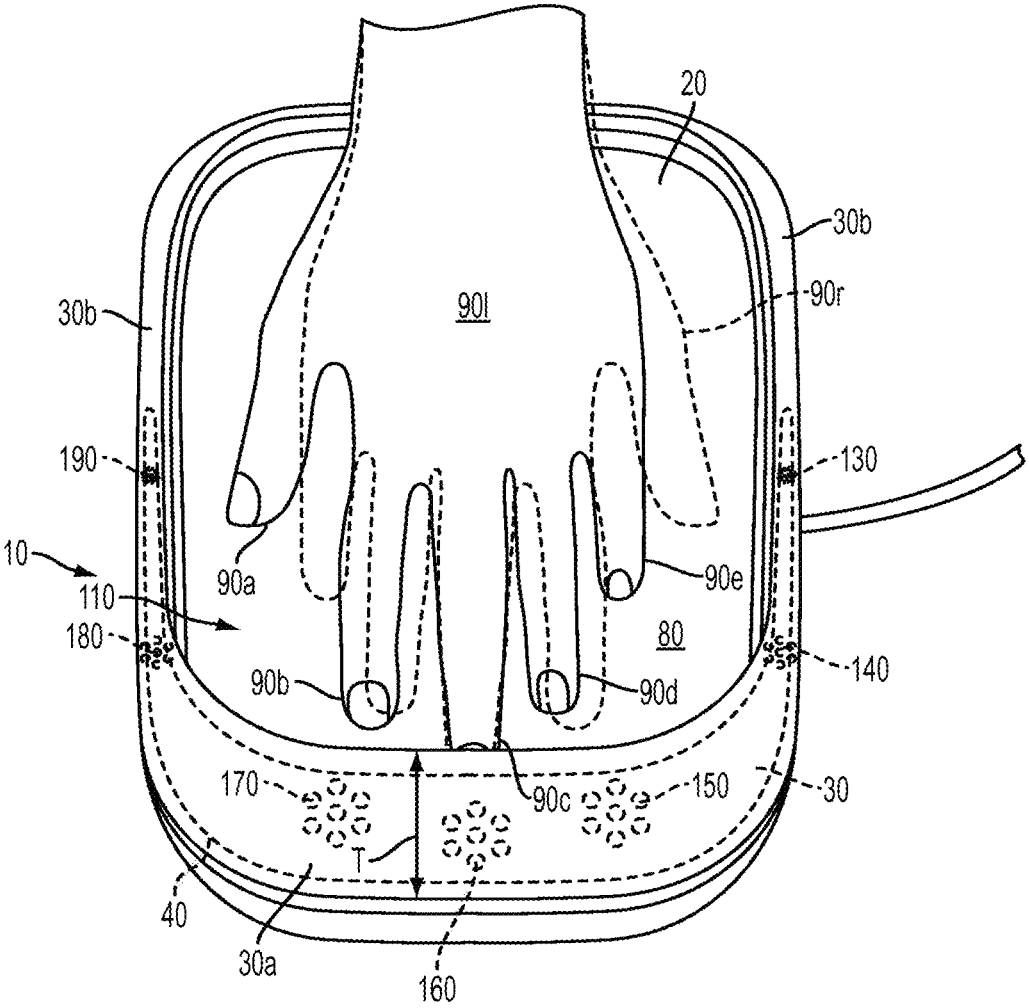
FIG. 4 is a top view of the nail lamp of FIG. 1.
Figure 5:
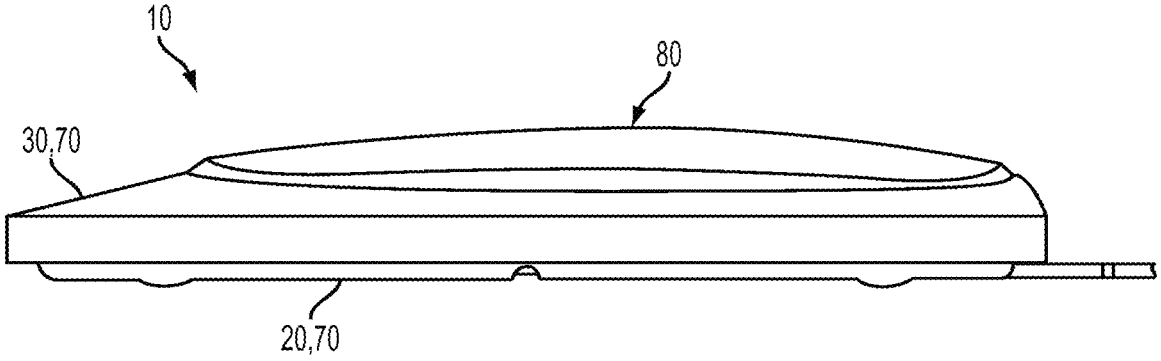
FIG. 5 is a left side view of the nail lamp of FIG. 1 with a support in a stowed position.

The support 30 pivotally connects to the base 20 for movement relative to the base 20 about a pivot axis 100 (see FIG. 1) between an operative position (shown in FIGS. 1-4) and an inoperative, stowed position (shown in FIG. 5). The support 30 pivots over an arc A (FIG. 1) that separates the operative and stowed pivotal positions. According to various embodiments, the arc A is greater than 10 degrees, greater than 20 degrees, and/or about 25 degrees. The lamp 10 is more compact when the support 30 is in the stowed position (FIG. 5) than when the support 30 is in the operative position (FIGS. 1-4). The stowed position facilitates easier storage and transportation of the lamp 10. According to various embodiments and as shown in FIG. 5, the array 40 of light sources 50 is enclosed within the lamp 10's housing (i.e., by being enclosed between the base 20 and the support 30) when the support 30 is in the stowed position. Consequently, positioning the support 40 in the stowed position protects the array 40 of light sources 50 during transportation and storage.

Although the illustrated lamp 10 relies on a pivotal connection between the base 20 and support 30 to facilitate movement between the operative and stowed positions, the support 30 may alternatively movably connect to the base 20 using any other suitable type of connection (e.g., four-bar linkage, sliding connection, etc.) without deviating from the scope of the present invention.

Alternatively, the support 30 could be rigidly connected to the base 20 without deviating from the scope of the invention. In such an embodiment, the support 30 would be permanently disposed in its operative position (for example, as illustrated by the lamp 3010 in FIGS. 14 and 15).

Moreover, the base 20 could be eliminated altogether without deviating from the scope of the present invention. For example, the components of the lamp 10 could be integrated into the support 30 such that the surface on which the support 30 is placed for use (e.g., table top) forms the platform 80 on which users place their nails.

According to various embodiments, left and right sides of the support 30 may be separable from each other (or pivotally connected to each other) to facilitate disassembly of the support 30 (e.g., to provide a more compact unit when not being used).

When the support 30 is in the operative position, a space 110 is defined by the support 30/array 40 and the platform 80 (e.g., beneath the array 40). As shown in FIGS. 1, 3, and 4, the space 110 is sized to accommodate therein all five nails 90*a*, 90*b*, 90*c*, 90*d*, 90*e* (see FIG. 4) on the appendage 90 of the user. The platform 80 defines a bottom of the space 110. In an embodiment that omits the base 20, a flat surface on which the support 30 was placed would define the bottom of the space 110. Moving the support 30 from the operative position to stowed position reduces a size of the space 110, and may eliminate the space 110. According to one or more embodiments, when the support 30 is in the stowed position, the space 110 (if present at all) may be inaccessible to a user because the space 110 is enclosed along with the light sources 50 between the support 30 and base 20.

As used herein, the term "nails" (e.g., the nails 90*a*, 90*b*, 90*c*, 90*d*, 90*e*) encompasses natural nails, artificial nails, and/or artificial nail tips.

Although the illustrated platform 80 and space 110 are sized to accommodate all five nails of a user's appendage 90, the platform 80 and space 110 may alternatively be sized to simultaneously accommodate a greater or fewer number of nails. For example, the platform 80 and space 110 may be sized to simultaneously accommodate the user's four nails 90*b*, 90*c*, 90*d*, 90*e*; sized to accommodate one nail at a time; or sized to simultaneously accommodate both of the user's hands (or feet) so as to accommodate all ten of the user's finger (or toe) nails (for example, the nail lamp 4010 discussed below).

When the support 30 is in the operative position, the structure of the lamp 10 provides an open architecture in which the space 110 is partially and/or substantially open to the ambient environment around the lamp 10 in a variety of directions (e.g., to the front, rear, left, right, and/or top of the space 110). As shown in FIG. 4, the U shape of the support 30 helps to facilitate this open architecture and provides a suitable structural connection between the U-shaped light array 40 and the base 20. As shown in FIG. 4, the curved part 30*a* of the U-shape of the support 30 is disposed toward the front of the lamp 10 (bottom of FIG. 4), while the ends 30*b* of the U-shape extend toward the rear of the lamp 10 (top of FIG. 4). As shown in FIGS. 1-4, although the overall support 30 is generally rectangular or O-shaped, the rectangle or "O" includes within it a U-shape. As used herein, the term "U-shaped" broadly encompasses a variety of bulging shapes (e.g., a horseshoe shape, a J-shape, a C-shape, a continuous or discontinuous curved shape having constant or changing radii of curvature, a "U" formed by three straight lines connected at 90 degree angles, etc.). The U-shape preferably generally follows the curved pattern of the nails 90*a*, 90*b*, 90*c*, 90*d*, 90*e* of a user's appendage 90. More preferably, the U-shape generally follows the curved nail pattern of overlaid left and right appendages 90*l* and 90*r*, respectively of a user so that the lamp 10 is designed for use by both the left appendage 90*l* and right appendage 90*r*. FIG. 4 illustrates such overlaid appendages 90 by showing a left hand 90*l* in solid lines and an overlaid right hand 90*r* in dotted lines.

As viewed from above as shown in FIG. 4, the support 30 is preferably thin so that the space 110 remains substantially open to the environment above the lamp 10. According to various embodiments, a thickness T of the support 30 (as shown in FIG. 4) remains less than 4, 3, 2.5, and/or 2 inches throughout the U-shape. In the illustrated support 30, the thickness T is the largest toward the middle of the U-shape, and is narrower on the left and right sides (e.g., less than 1 inch thick, less than 0.5. inches thick at the sides).

As used herein, the term "substantially open" with respect to a direction means that at least 40% of a projected area of the space 110 in that direction (e.g., front, rear, left, right) is unobstructed by the structure of the lamp 10. For example, as shown in FIG. 1, the space 110 is substantially open to the ambient environment to the left of the lamp 10 despite the limited (i.e., less than 50%) obstruction caused by the left side of the support 30. Similarly, as shown in FIG. 4, the space 110 is substantially open to the ambient environment above the lamp 10 despite the limited (i.e., less than 50%) obstruction caused by the support 30. According to one or more embodiments, the at least 20%, 30%, 40%, 50%, 60%, 70%, 80%, and/or 90% of a projected area of the space in one or more directions (e.g., front, rear, left, right, top) may be unobstructed by the structure of the lamp 10.

Figure 6:
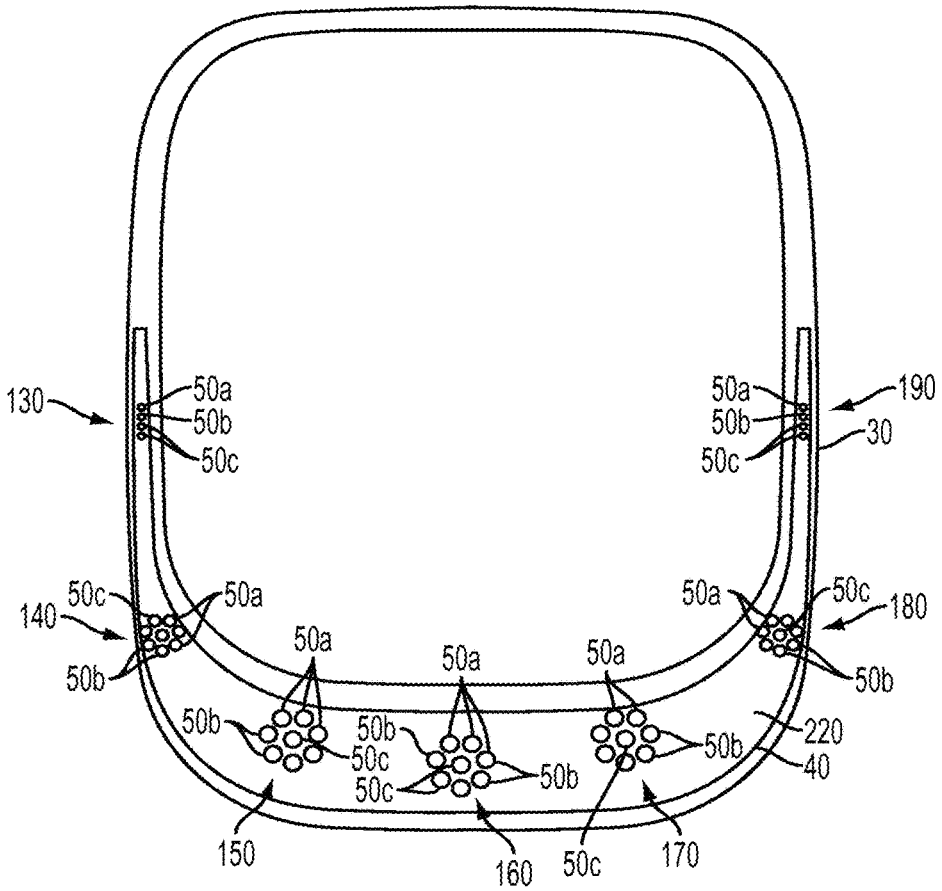
FIG. 6 is a bottom view of the support of the nail lamp of FIG. 1.

The array 40 of discrete light sources 50 is supported by the support 30 and is positioned relative to the space 110 so as to direct light from the light sources 50 to the user's five nails 90*a*, 90*b*, 90*c*, 90*d*, 90*e*. As shown in FIGS. 4 and 6, the array 40 of discrete light sources 50 is divided into a plurality of clusters 130, 140, 150, 160, 170, 180, 190 of light sources 50. As shown in FIG. 6, the plurality of clusters are arranged in a U-shaped pattern that follows the U-shape of the support 30 and the user's nails.

The array 40 may be removably mounted to the support 30 (e.g., via manually actuatable clip(s), screws, etc.) such that an array 40 may be easily replaced with a different array 40 having different characteristics (e.g., different light wavelength profiles designed to cure different nail products, different light source 50 positioning designed to accommodate a different set of nail(s)). For example, separate interchangeable arrays 40 may be provided for each of the user's right and left hands and feet. Although the arrays are illustrated throughout this description as containing a number and arrangement of discrete light sources 50 of a particular size, any array may include more or fewer discrete light sources 50 and may be arranged in any suitable pattern. It is specifically noted that the invention may utilize a fewer number of higher intensity discrete light sources 50 where each of the discrete light sources 50 is physically larger in size. Similarly, the clusters may contain fewer or more discrete light sources 50. For example, in embodiments that include two sets of discrete light sources 50 having two different wavelength profiles (as described further below), a cluster may be two lights; and in embodiments that include three sets of discrete light sources 50 having three different wavelength profiles, a cluster may be two or three lights.

As shown in FIG. 4, the cluster 160 is positioned to direct light from the cluster's light sources 50 to a nail 90*c* of a middle finger of the user's left or right hand. The clusters 150, 170 are disposed on left-rear and right-rear sides, respectively, of the cluster 160 and are positioned to direct light from their respective light sources 50 to nails 90*d*, 90*b* on the index and ring fingers, respectively, of the user's hand, depending on whether the user's right or left hand 90 is disposed in the space 110. The cluster 140 is disposed to the left-rear of the cluster 150 and is positioned to direct light from the light sources 50 of the cluster 140 to the pinky nail 90*e* of the user's left hand. Similarly, the cluster 180 is disposed to the right-rear of the cluster 170 and is positioned to direct light from the light sources 50 of the cluster 180 to the pinky nail of the user's right hand. The cluster 190 is disposed to the right-rear of the cluster 180 and is positioned to direct light from the light sources 50 of the cluster 190 to the thumb nail 90*a* of the user's left hand. Similarly, the cluster 130 is disposed to the left-rear of the cluster 140 and is positioned to direct light from the light sources 50 of the cluster 130 to the thumb nail of the user's right hand.

The clusters 140, 150, 160, 170, 180 project light generally downwardly toward and onto the user's nails 90*b*, 90*c*, 90*d*, 90*e*. Because the thumb nail 90*a* is angled at about 60° from a horizontal orientation of the user's other four nails, the thumb-specific clusters 130, 190 may be oriented at matching angles, for example a 60° angle, a 45° angle or a 90° angle, so as to more perpendicularly project light toward and onto the user's thumb nail 90*a*.

Although the positioning of the clusters has been described as accommodating a user's hand appendage 90, the clusters may additionally or alternatively be positioned to direct light from the light sources 50 to the nails of the user's foot appendage.

As shown in FIG. 1, the controller 60 operatively connects the light sources 50 to a power source 65 (e.g., a DC battery, 110V AC wall socket). As shown in FIG. 1, the controller 60 includes a manually-actuatable switch 62 that a user may actuate to turn the lamp 100 ON and OFF (i.e., by electrically connecting/disconnecting the light sources 50 to/from the power source 65. The controller 60 can be any type of suitable controller (analog or digital circuit, electromechanical switch, programmed chip-based CPU, etc.).

In the illustrated embodiment, the power source 65 is an external power source that connects to the controller 60 via suitable wires 68 (e.g., an electrical plug for use with a wall socket electrical outlet). However, the power source 65 (e.g., a battery power source) may alternatively be housed within the housing 70 (e.g., within the base 20) without deviating from the scope of the present invention.

The controller 60 has left hand and right hand ON states. In the left hand ON state, the controller 60 delivers electric power to the clusters 140, 150, 160, 170, 190 so as to direct light to the nails of the user's left hand, while not delivering power to the right-hand specific clusters 130, 180. Conversely, in the right hand ON state, the controller 60 delivers electric power to the clusters 130, 150, 160, 170, 180 so as to direct light to the nails of the user's right hand, while not delivering power to the left hand specific clusters 140, 190. The controller 60 may cycle through the OFF, left hand ON, and right hand ON states in a variety of ways. In a manual embodiment, the controller may be configured to sequentially cycle to the next of the OFF, left hand ON, and right hand ON (or vice versa) states in response to sequential manual actuation of the switch 62 (e.g., a momentary switch) or another switch. In an automated embodiment, the controller 60 may be configured to respond to actuation of the switch 62 by going into one of the left hand and right hand ON states for a predetermined period of time, thereafter automatically going into the other of the left and right hand ON states for a predetermined period of time, and then automatically returning to the OFF state. As shown in FIG. 2, left and right hand indicator lights 63, 64, respectively, operatively connect to the controller 60 and are selectively illuminated by the controller 60 to indicate whether the lamp 10 is in the left hand or right hand ON state. The controller 60 may provide an audible alert when switching between the different states to indicate to the user to switch hands, or that the predetermined time has elapsed. The predetermined time may be adjustable by a user so as to correspond to an appropriate curing time for the light-curable (e.g., photopolymerizable) product on the user's nails.

As shown in FIG. 2, a display 165 (e.g., LCD, LED, etc.) is operatively connected to the controller 60 and displays a time remaining for a current curing procedure. Curing times may be tailored to account for various lamp 10 and nail product parameters (e.g., the particular light sources 50 being used (e.g., their intensity and wavelength profiles), the light sources' distance to the nails and angle of incidence on the nails, the type of nail product, etc.). According to various embodiments, the lamp 10 may cure the uncured nail product on a user's nail in less than 10 minutes, less than 5 minutes, less than 3 minutes, less than 2 minutes, less than 1 minute, less than 30 seconds, and/or less than 15 seconds. According to various embodiments, the cure time may be between 5 seconds and 10 minutes. According to one embodiment, the cure time for a base coat is about 10-20 seconds, and the cure time for a subsequent color coat or top coat is about 0-2 minutes, 30-90 seconds, and/or 60-90 seconds.

In the illustrated embodiment, thumb-specific clusters 130, 190 are discrete from the pinky-specific clusters 140, 180. However, according to an alternative embodiment, the clusters 180, 190 may be integrated with each other and the clusters 130, 140 may be integrated with each other so that a single cluster accommodates the pinky on one hand and the thumb on the other hand, depending upon which hand the user places in the space 110. In such an embodiment, a single ON state would replace the discrete left hand and right hand ON states of the illustrated lamp 10.

In an embodiment in which the platform 80 and space 110 are sized to simultaneously accommodate both of the user's overlaid hands 90 (e.g., similar to the left and right hand positions shown in FIG. 4, but with the top hand 90 pulled rearwardly relative to the bottom hand 90 so that all ten nails are exposed), the controller 60 may simultaneously turn on all of the clusters 130, 140, 150, 160, 170, 180, 190. In such an embodiment, one or more of the clusters 130, 140, 150, 160, 170, 180, 190 may be elongated in the front/rear direction (up/down as viewed in FIG. 4) to simultaneously accommodate the nails on the user's relatively forwardly disposed lower hand 60 and relatively rearwardly disposed upper hand 90.

According to an alternative embodiment, the switch 62 may be automatically actuated by moving the support 30 between the operative and stowed positions. For example, moving the support 30 from the stowed position to the operative position may actuate the switch 62, which causes the controller 60 to move into an ON state that turns on some or all of the light sources 50. Conversely, moving the support 30 from the operative position to the stowed position may actuate the switch 62 and cause the controller to move into the OFF state that turns off the light sources 50.

While the switch 62 is disposed on the base 20 in the illustrated lamp 10, the switch 62 may alternatively be disposed in any other suitable location (e.g., on the support 30, integrated into the electric cord 68).

According to one or more embodiments, the use of nail-specific clusters 130, 140, 150, 160, 170, 180, 190 focuses light on the user's nails while reducing the user's skin exposure to such light.

As explained hereinafter, the array 40 of discrete light sources 50 includes light sources 50*a*, 50*b*, 50*c*, that have different light wavelength profiles. The combination of different light wavelength profiles may improve the light-curing characteristics of the lamp 10 (e.g., by providing more rapid curing, by providing more even curing throughout the thickness of a light-curable nail product on a single nail, by enabling full curing with a lower overall light intensity than in various conventional nail lamps). For example, different wavelength light may penetrate the light-curable nail product to a different extent, thereby improving the overall curing of the light-curable nail product throughout the thickness of the nail product.

As shown in FIG. 6, each of the clusters 130, 140, 150, 160, 170, 180, 190, of discrete light sources 50 include a combination of discrete light source(s) 50*a*, discrete light source(s) 50*b*, and discrete light source(s) 50*c*. The different clusters 130, 140, 150, 160, 170, 180, 190 preferably each include at least one light source 50*a*, at least one light source 50*b*, and at least one light source 50*c*. Each cluster 130, 140, 150, 160, 170, 180, 190 more preferably includes a plurality of each type 50*a*, 50*b*, 50*c* of light source 50. However, one or more of the clusters 130, 140, 150, 160, 170, 180, 190 may omit light sources 50 from one or more of the light source types 50*a*, 50*b*, 50*c* without deviating from the scope of the present invention.

Figure 7:
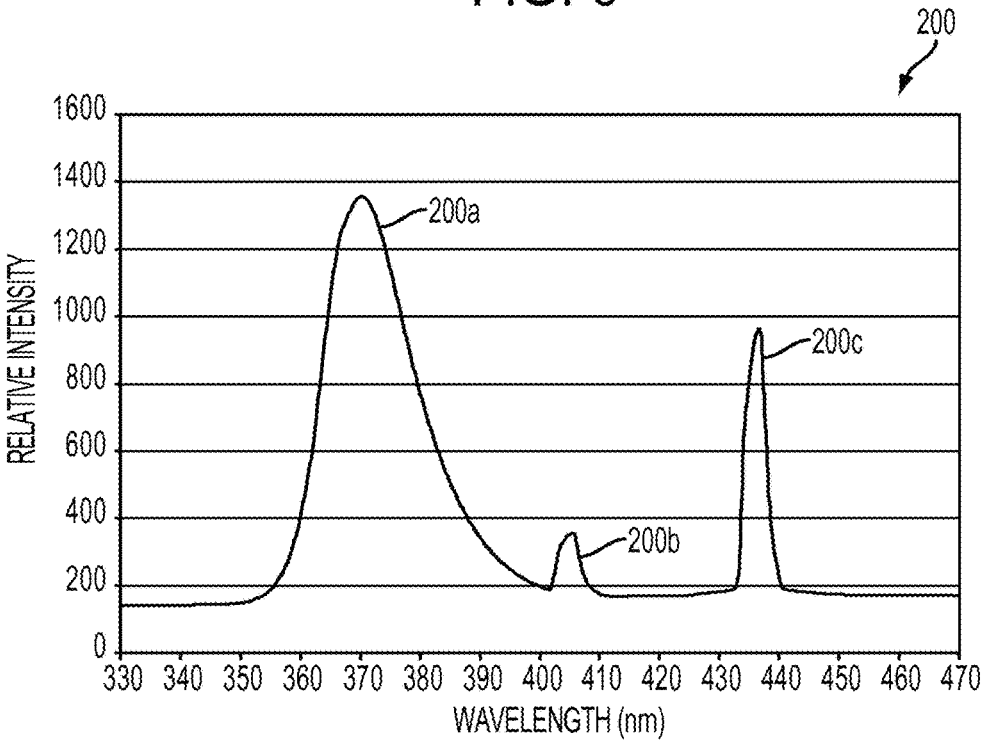
FIG. 7 is a graph illustrating a light wavelength profile of a light source cluster of the nail lamp of FIG. 1.
Figure 8:
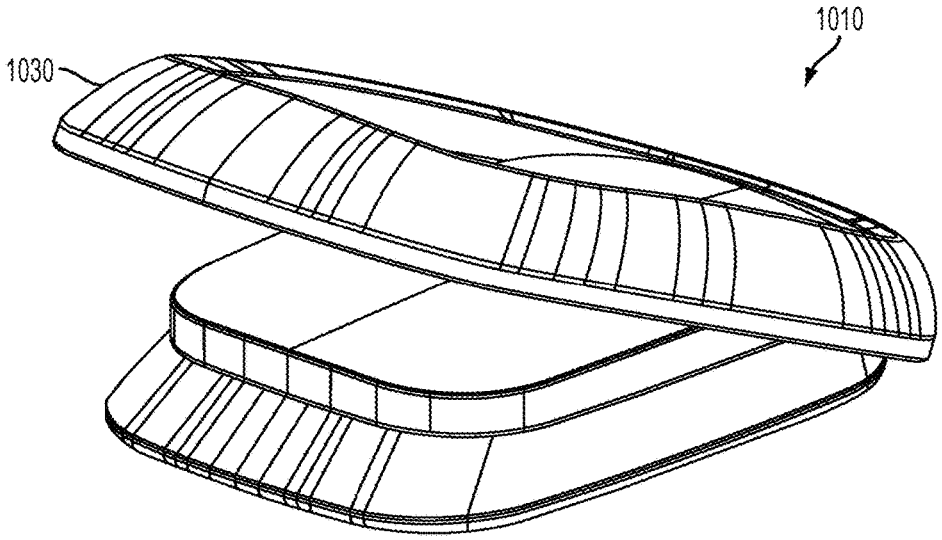
FIG. 8 is a left perspective view of a nail lamp according to an alternative embodiment.
Figure 9:
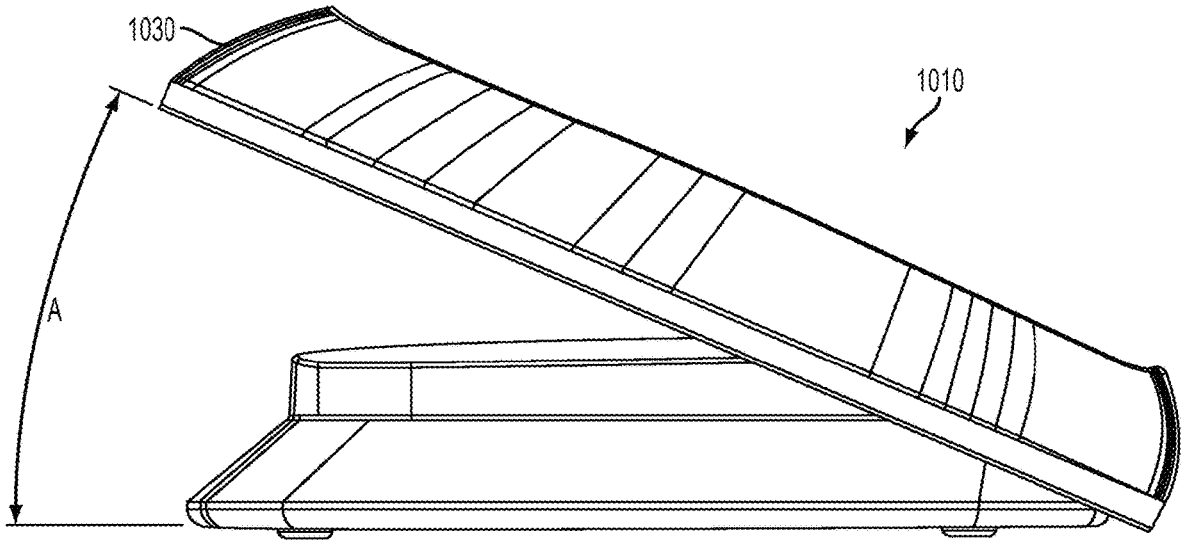
FIGS. 9 and 10 are left side views of the nail lamp of FIG. 8 with the support in operative and stowed positions, respectively.
Figure 10:
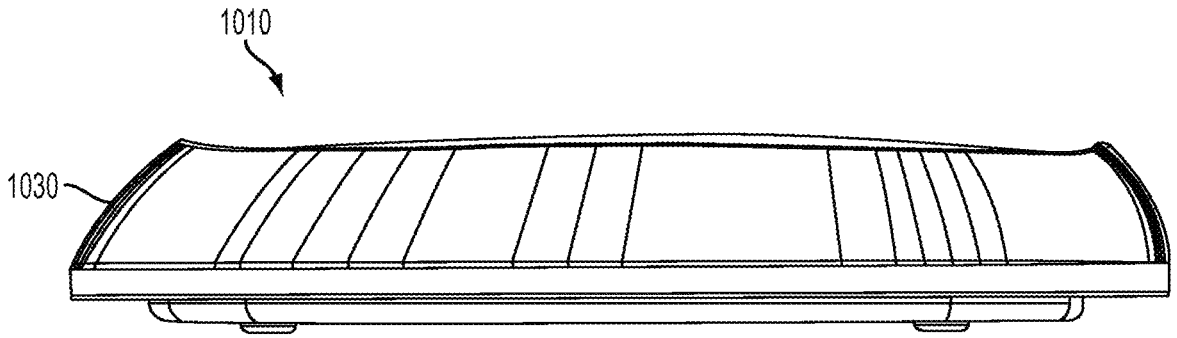
Figure 11:
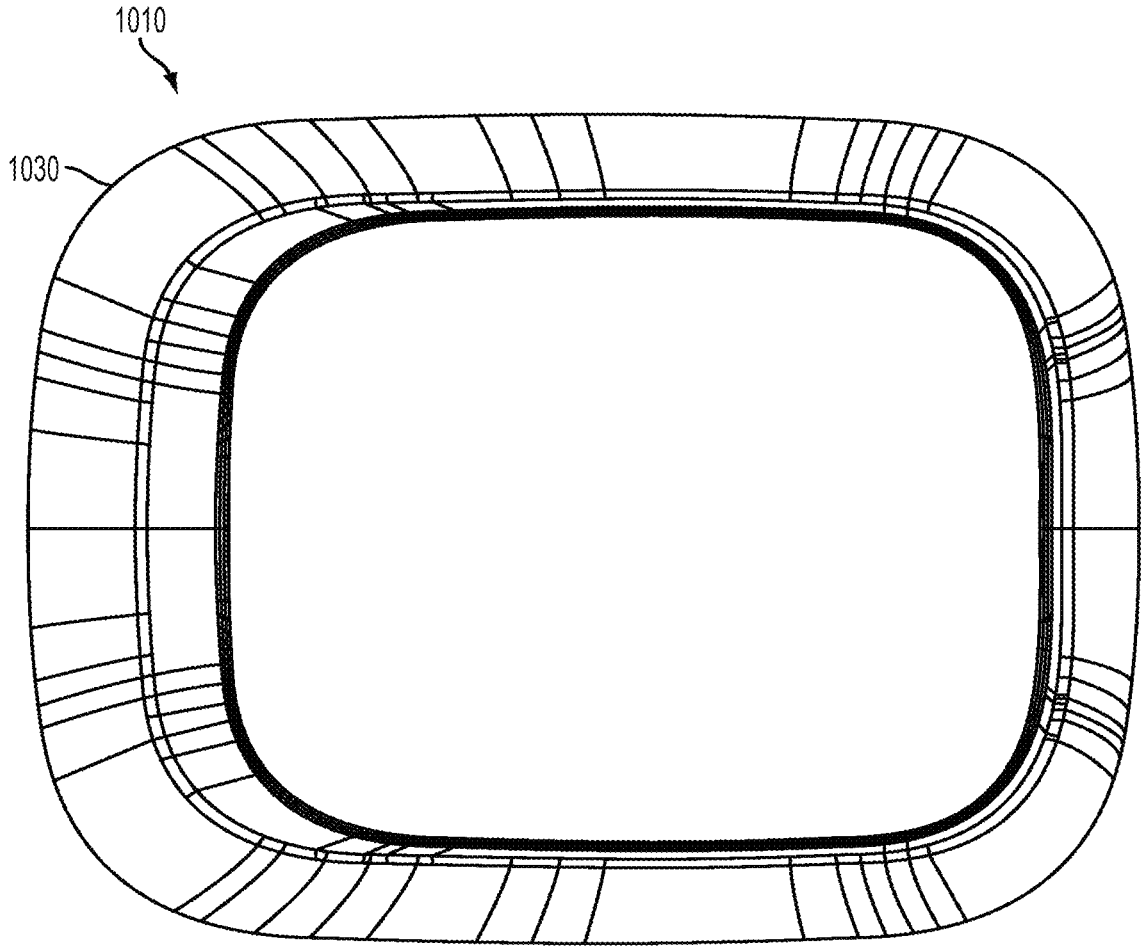
FIG. 11 is a top view of the nail lamp of FIG. 8.

FIG. 7 illustrates the overall light wavelength profile 200 of one of the clusters 130, 140, 150, 160, 170, 180, 190. The different clusters 130, 140, 150, 160, 170, 180, 190 may all have the same overall light wavelength profile or different light wavelength profiles.

As shown in FIG. 7, the different light sources 50*a*, 50*b*, 50*c* have different light wavelength profiles than each other. In particular, the overall light wavelength profile 200 of the cluster 130, 140, 150, 160, 170, 180, 190 is made up of the combination of discrete light wavelength profiles 200*a*, 200*b*, 200*c* of the discrete light sources 50*a*, 50*b*, 50*c*, respectively.

The light sources 50*a* have a light wavelength profile 200*a* that has a maximum intensity at a wavelength less than 400 nm, 390 nm, or 385 nm and/or greater than 340 nm, 350 nm, or 360 nm. According to one embodiment, the light wavelength profile 200*a* has a maximum intensity between about 360 and about 380 nm.

The light sources 50*b* have a light wavelength profile 200*b* that has a maximum intensity at a wavelength less than 430 nm, 420 nm, or 410 nm and/or greater than 380 nm, 385 nm, 390 nm, or 400 nm. According to one embodiment, the light wavelength profile 200*b* has a maximum intensity between about 385 and about 425 nm.

The light sources 50*c* have a light wavelength profile 200*c* that has a maximum intensity at a wavelength less than 470 nm, 460 nm, or 450 nm and/or greater than 410 nm, 420 nm, 425 nm, or 430 nm. According to one embodiment, the light wavelength profile 200*c* has a maximum intensity between about 430 and about 445 nm.

Each of the light wavelength profiles 200*a*, 200*b*, 200*c* is different from each other profile 200*a*, 200*b*, 200*c*.

According to various embodiments, the light wavelength profiles 200*a*, 200*b*, 200*c* of the light sources 50*a*, 50*b*, 50*c* each have a maximum intensity at a wavelength that is less than 475 nm, less than 460 nm, and/or less than 450 nm.

Although particular wavelengths have been described with respect to particular light sources 50*a*, 50*b*, 50*c*, the wavelengths of any and all of the light sources 50 may alternatively have any other suitable wavelengths and/or wavelength patterns without deviating from the scope of the present invention. For example, the wavelengths may be specifically tailored to cure a particular type of light-curable nail product. While the illustrated wavelengths are in the UV spectrum, wavelengths outside of the UV spectrum may additionally and/or alternatively be used, depending on what wavelength radiation is suitable for curing the targeted light-curable nail product. Indeed, the light sources may provide any type of suitable light (e.g., ultra violet, infrared, actinic radiation, other light within or outside the visible spectrum) for curing the associated light-curable nail product.

While the illustrated lamp 10 utilizes light sources 50 with different wavelength profiles, all of the light sources 50 may alternatively have the same light wavelength profile without deviating from the scope of the present invention.

As shown in FIG. 6, the array 40 of discrete light sources 50 includes one or more circuit boards 220 onto which the discrete light sources 50*a*, 50*b*, 50*c* are mounted. Each discrete light source 50*a*, 50*b*, 50*c* can be a LED that has its own discrete lens. However, according to an alternative embodiment, multiple discrete light sources 50*a*, 50*b*, 50*c* could share a single lens while still being discrete light sources 50. For example, a single lens could cover three discrete LED semiconductor junctions of three light sources 50*a*, 50*b*, 50*c*, respectively. Although the light emitted from the lens would have the combined light wavelength profiles of the light sources 50*a*, 50*b*, 50*c*, the light sources 50*a*, 50*b*, 50*c* would nonetheless be discrete from each other because their respective LED semiconductor junctions remain discrete.

According to alternative embodiments, the LED light sources 50*a*, 50*b*, 50*c* may be replaced any other suitable types of light sources 50 (e.g., florescent, gas discharge) without deviating from the scope of the present invention.

Unlike conventional nail lamps that utilize light sources that focus on a single wavelength, light sources 50*a*, 50*b*, 50*c* of lamp 10 provide a wider range of light wavelengths, which has been found to improve performance in curing one or more types of light-curable nail products. Consequently, one or more embodiments of the invention can use an array 40 of light sources 50*a*, 50*b*, 50*c* with a lower overall intensity than was used by various conventional nail lamps that focused on a single wavelength.

Use of the lamp 10 to cure light-curable nail product on a user's nail(s) is hereinafter described with reference to FIG. 1. The user moves the support 30 into the operative position and places his/her appropriate appendage into the space 110. Although described below with respect to nails on the hand (fingers), it is to be understood that the method applies to other appendages, e.g. feet, as well. The user actuates the switch 62 (if the lamp 10 is not configured to automatically turn ON), which causes the controller 60 to enter the left (or right) hand ON state and turn on the corresponding clusters of light sources 50. The light sources 50 direct light onto the uncured light-curable nail product and cure the nail product. The user then actuates the switch 62 to switch the controller 60 to the other hand's ON state (if the controller 60 does not automatically do so) and places his/her other appendage into the space 110. The controller 60 responsively turns on the corresponding light sources 50, which direct light on to the user's nails and cure the uncured light-curable nail product thereon.

FIGS. 8-11 illustrate a lamp 1010 according to an alternative embodiment of the present invention. The lamp 1010 is generally similar to the lamp 10. To avoid redundant description of similar features between the lamp 1010 and lamp 10, similar features in the lamp 1010 will be referenced by the number 1000 larger than the comparable reference number used in the lamp 10. Although the support 1030 of the lamp 1010 is slightly differently shaped than the corresponding support 30 of the lamp 10, the support 1030 remains U-shaped.

Figure 12:
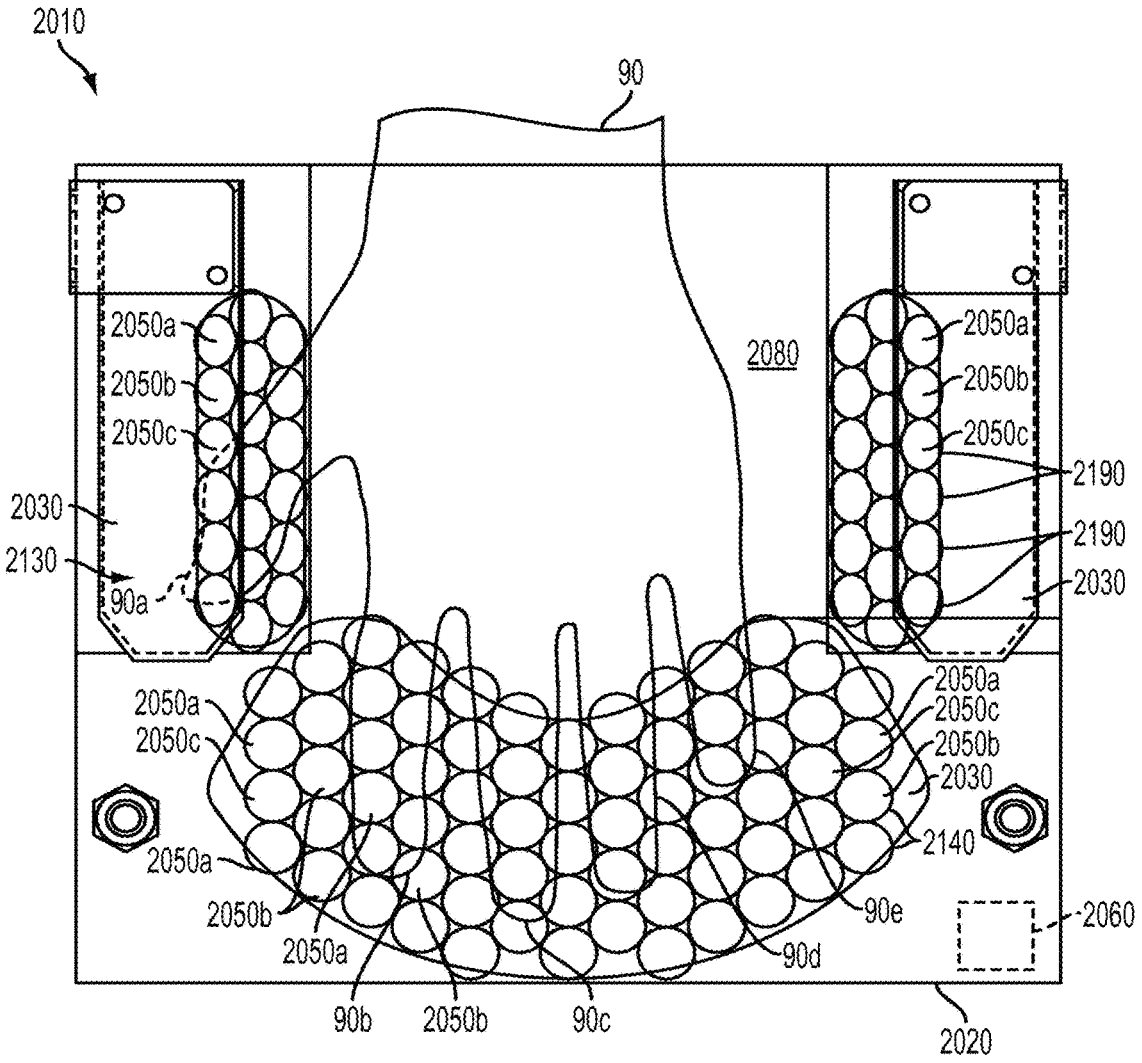
FIG. 12 is a top view of the light source configuration according to an alternative embodiment of a nail lamp.
Figure 13:
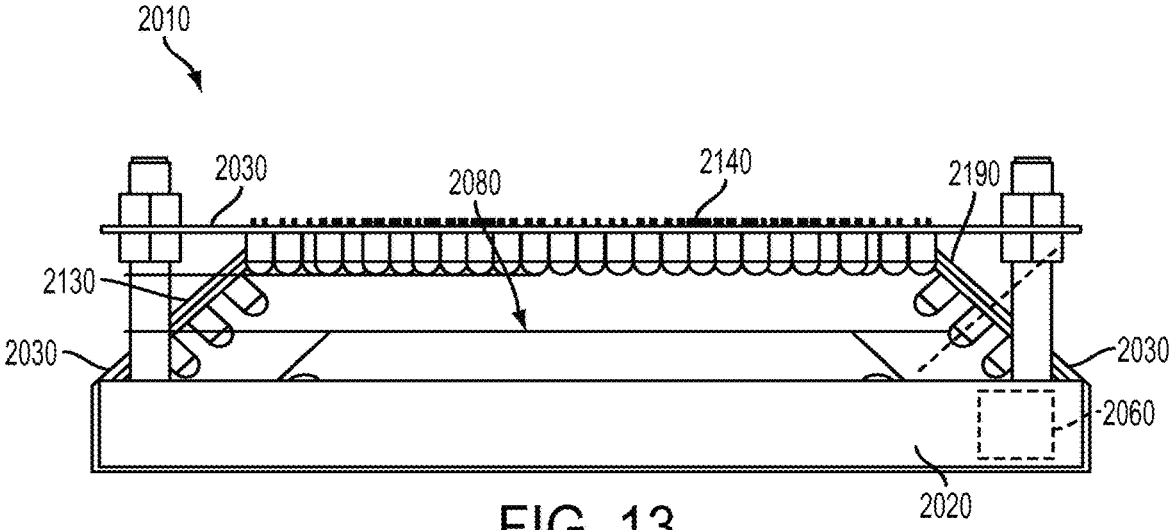
FIG. 13 is a front view of the light source configuration of the nail lamp of FIG. 12.

According to one or more alternative embodiments, two or more of the clusters 130, 140, 150, 160, 170, 180, 190 may be combined such that the light sources 50 are more evenly distributed throughout the U-shaped array 40 without deviating from the scope of the present invention. For example, FIGS. 12 and 13 illustrate a nail lamp 2010 according to an alternative embodiment. To avoid redundant description, components of the lamp 2010 that are similar to components of the lamp 10 are identified using reference numbers 2000 higher than the corresponding component in the lamp 10. The lamp 2010 is generally similar to the lamp 10 except for the consolidation of the lamp 10's clusters 140, 150, 160, 170, 180 for the nails 90*b*, 90*c*, 90*d*, 90*e* into a consolidated, U-shaped cluster 2140 of light sources 2050*a*, 2050*b*, 2050*c*. As shown in FIG. 13, the cluster 2140 is generally parallel to the upper surface of the platform 2080. As shown in FIG. 13, the clusters 2130, 2190 of light sources 2050*a*, 2050*b*, 2050*c* are oriented at a 45° angle relative to the upper surface of the platform 1080 in order to generally accommodate the orientation of the user's left and right thumb nails, respectively. In other embodiments, the clusters 2130, 2190 of light sources 2050*a*, 2050*b*, 2050*c* can be oriented at a 60° angle or a 90° angle relative to the upper surface of the platform 1080.

A controller 2060 of the lamp 2010 may simultaneously turn all of the clusters 2130, 2140, 2190 on or off. Alternatively, the controller 2060 may have (a) a left hand state that turns on the clusters 2130, 2140 but not the cluster 2190, and (b) a right hand state that turns on the clusters 2140, 2190 but not the cluster 2130.

In the lamp 2010, the clusters 2130, 2140, 2190 and support 2030 rigidly mount (e.g., via bolts) to the base 2020 such that the support 2030 and clusters 2130, 2140, 2190 are always in the operative position. As shown in FIGS. 12 and 13, the support 2030 contains the semiconductor substrates to which the light sources 2050*a*, 2050*b*, 2050*c* are mounted. The support 2030 additionally includes a cover (not shown) that is similar to that shown in the lamp 10.

Figure 14:
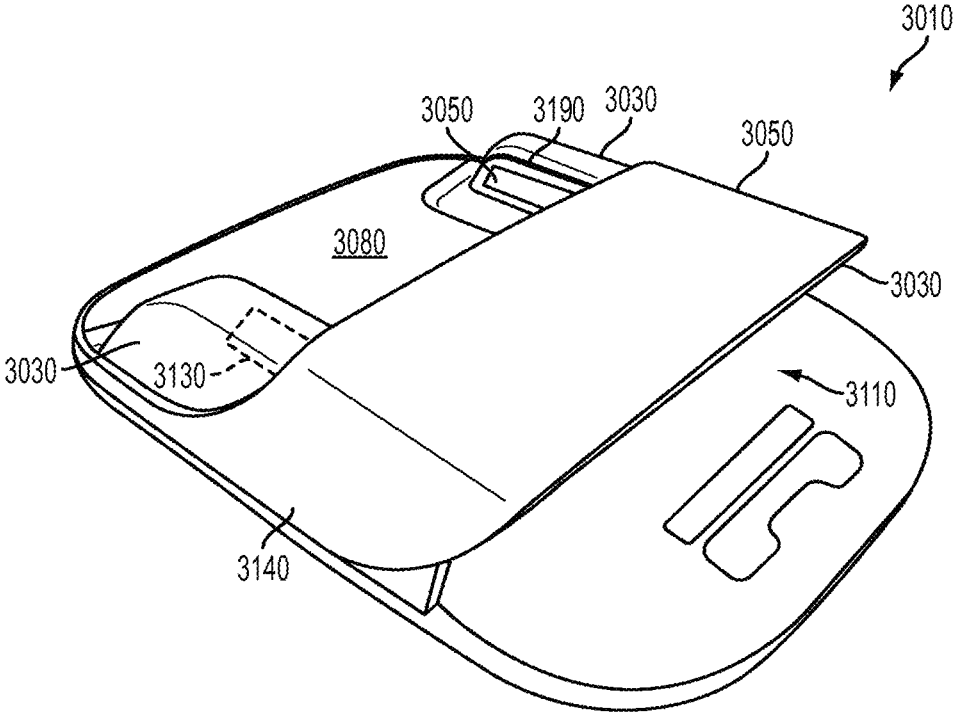
FIG. 14 is a front perspective view of a nail lamp according to an alternative embodiment.
Figure 15:
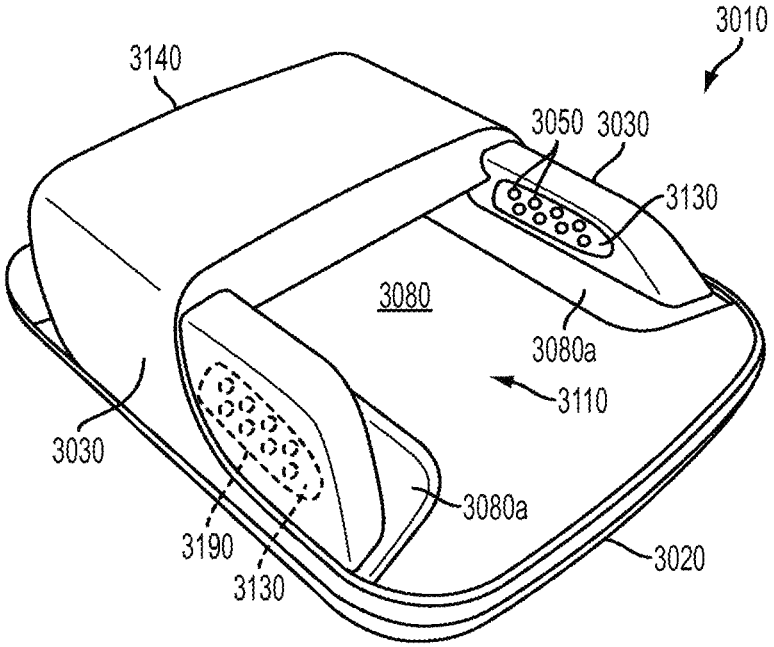
FIG. 15 is a rear perspective view of the nail lamp of FIG. 14.
Figure 16:
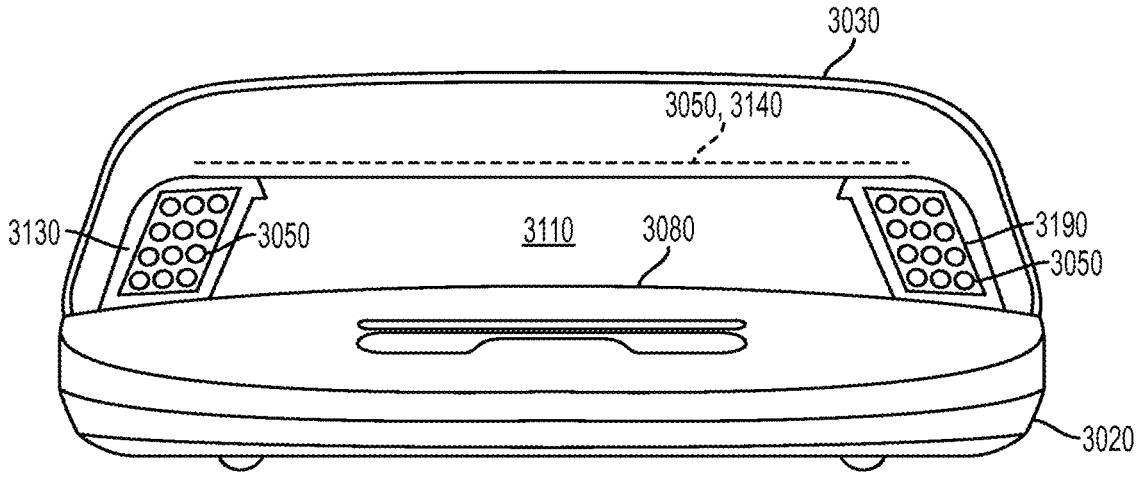
FIG. 16 is a front view of the nail lamp of FIG. 14.

FIGS. 14-16 illustrate a lamp 3010 according to an alternative embodiment of the present invention. To avoid redundant description, components of the lamp 3010 that are similar to components of the lamps 10 or 2010 are identified using comparable reference numbers in the 3000 range (e.g., base 3020 corresponds to base 20 and base 2020 in lamp 10 and lamp 2010, respectively). The lamp 3010 is similar to the lamps 10 and 2010, except that the support 3030 is rigidly connected to the base 3020 such that the support 3030 is always in its operative position and the space 3110 is always sized to accommodate the user's appendage. As in the lamp 2010, the lamp 3010 includes three light clusters 3130, 3140, 3190 that each include light sources 3050 with different wavelength profiles. As shown in FIG. 15, the platform 3080 can include thumb depressions 3080*a* adjacent the clusters 3130, 3190. The thumb depressions 3080*a* are lower than the adjacent portion of the platform 3080 to provide for more comfortable positioning of the user's hand on the platform 3080.

FIGS. 17-20 illustrate a lamp 4010 according to an alternative embodiment of the present invention. To avoid redundant description, components of the lamp 4010 that are similar to components of the lamps 10 or 2010 are identified using comparable reference numbers in the 4000 range (e.g., base 4020 corresponds to bases 20 and base 2020 in lamp 10 and lamp 2010, respectively). Similar to lamp 3010, the support 4030 is rigidly connected to the base 4020 such that the support 4030 is always in its operative position and the space 4110 is always sized to accommodate the user's appendage. As in the lamp 3010 includes three light clusters 4130, 4140, 4190 that each include light sources 4050 with different wavelength profiles. Although not shown, the platform 4080 can optionally include thumb depressions positioned similar to thumb depressions 3080*a* of lamp 3010.

Figure 17:
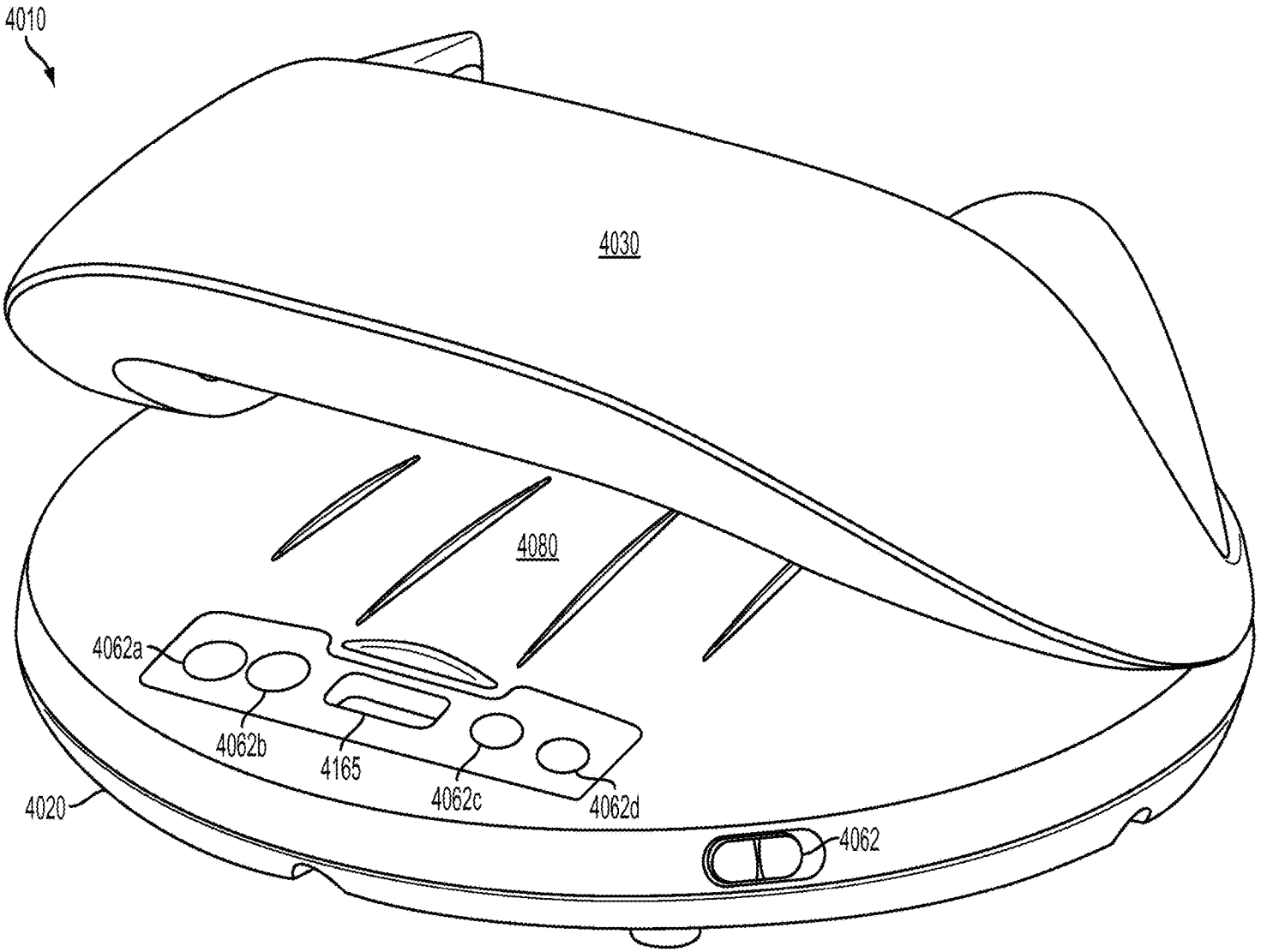
FIG. 17 is a top front perspective view of a nail lamp according to an alternative embodiment.
Figure 18:
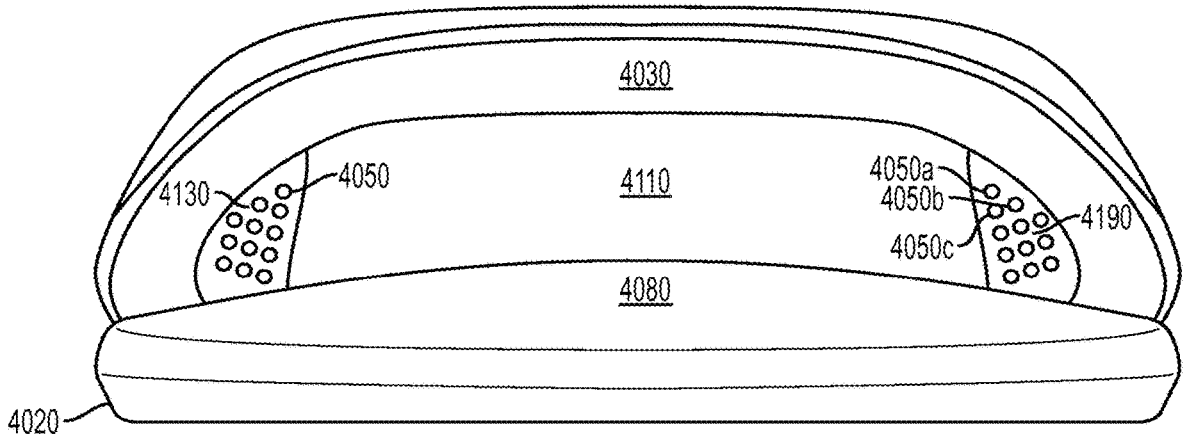
FIG. 18 is a front view of the nail lamp of FIG. 17.

As shown in FIG. 17, the base 4020 can include a switch 4062 which in the illustrated embodiment is on the side of base 4020. In this embodiment, the switch 4062 can operate as a simple on/off switch. Additional switches 4062*a*, 4062*b*, 4062*c*, 4062*d* in the form of buttons control aspects of the illumination of discrete light sources 4050. For example, additional switches 4062*a*, 4062*b* may set a specific time for illumination, for example 30 and 60 seconds respectively, and additional switches 4062*c*, 4062*d* may modify the illumination time by, for example, adding or subtracting time in one second increments. In these embodiments, display 4165 may be an LCD screen that indicates the set illumination time.

In other embodiments, each additional switch may be used to turn on light sources of discrete wavelengths. For example, additional switch 4062*a* may operate to turn on and off light sources 4050*a* of a first wavelength, additional switch 4062*b* may operate to turn on and off light sources 4050*b* of a second wavelength, and additional switch 4062*c* may operate to turn on and off light sources 4050*c* of a third wavelength. In such an embodiment, the display 4165 may indicate which wavelengths of light are being emitted. Alternatively, the additional switches may operate to turn on and off various arrays of discrete light sources. For example, additional switch 4062*b* may operate to turn on and off all light sources of array 4130, additional switch 4062*c* may operate to turn on and off all light sources of array 4140, and additional switch 4062*d* may operate to turn on and off all light sources of array 4190. While described above as including three different discrete light sources 4050*a*, 4050*b*, and 4050*c* with three different wavelength profiles, it will be appreciated that all discrete light sources have the same wavelength profile or that there may be two different discrete light sources 4050*a* and 4050*b* with two different wavelength profiles. The invention may include fewer or more additional switches depending upon the overall configuration and need for control. Display 4165 can take on other forms such as indicator lights similar to indicator lights 63 and 64 described above. The display 4165 may also display multiple functions, for example by including both an LCD display and indicator lights.

Figure 19:
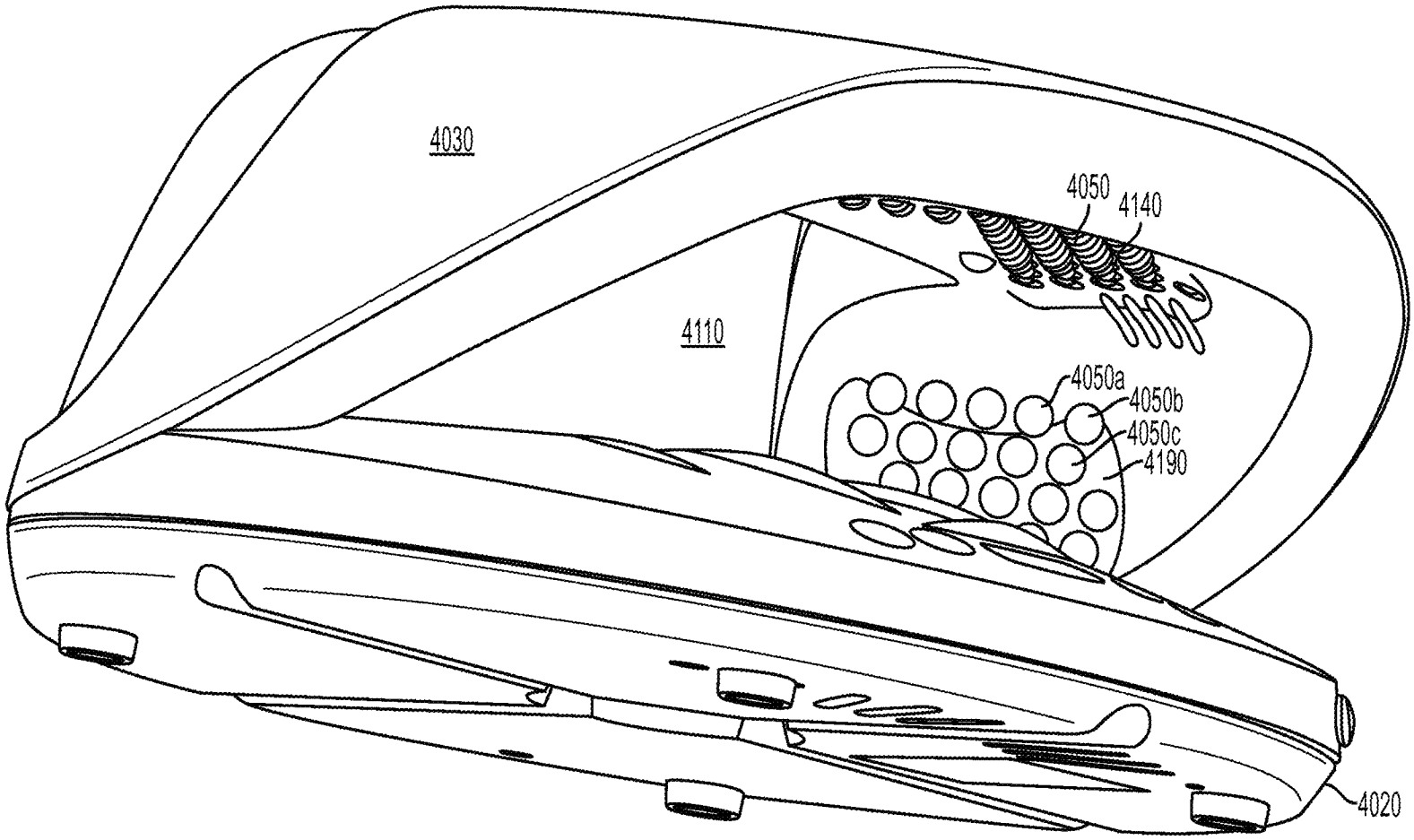
FIG. 19 is a right perspective view of the nail lamp of FIG. 17.
Figure 20:
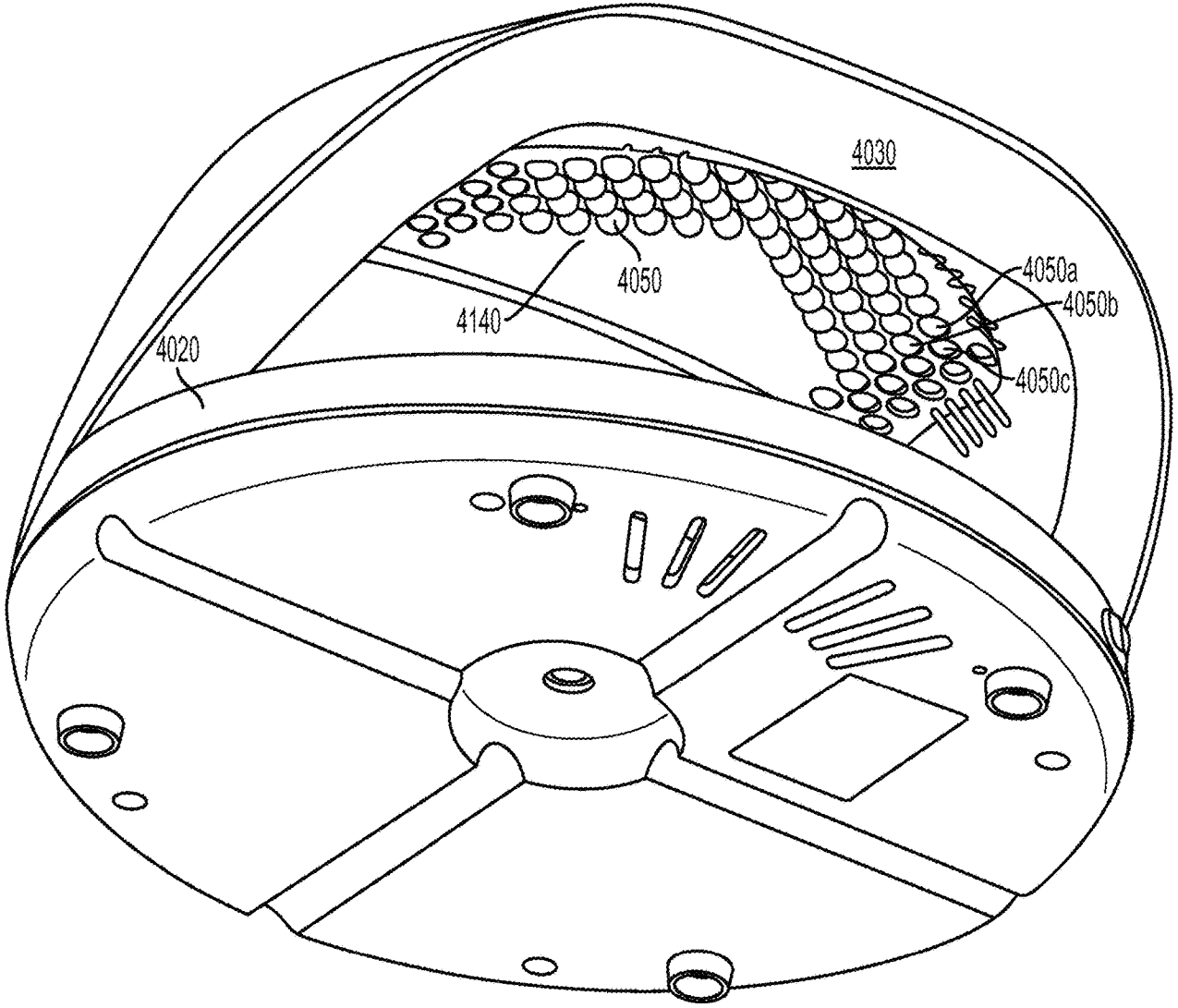
FIG. 20 is a bottom front perspective view of the nail lamp of FIG. 17.

As shown in FIGS. 19-20, and similar to lamp 2010 illustrated in FIGS. 12-13, the illustrated embodiment of lamp 4010 clusters 140, 150, 160, 170, 180 of lamp 10 are consolidated into a V shaped cluster 4140 of light sources 4050*a*, 4050*b*, 4050*c*. The cluster 4140 is generally parallel to the upper surface of the platform 4080. The V shaped cluster 4140 generally follows the shape of the four fingers of a hand with the apex (point) of the V positioned to illuminate a middle finger and the sides positioned to illuminate the shorter ring finger, index finger and pinky finger. As in other embodiments, arrays 130, 190 are positioned in the sides of support 4030 for illuminating the thumb of the right and left hand, respectively.

Figure 21:
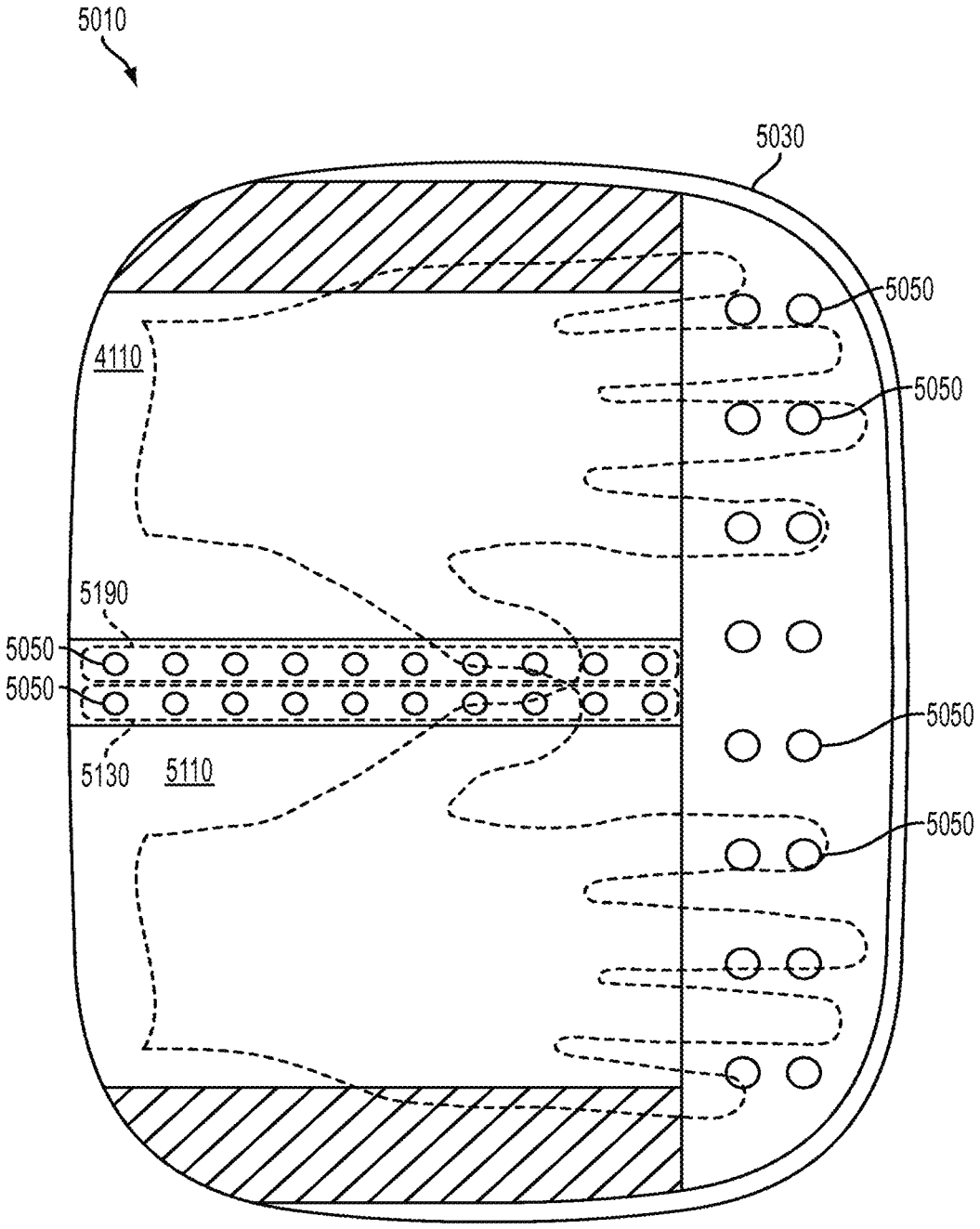
FIG. 21 is a partial bottom view of a nail lamp according to an alternative embodiment of the present invention.
Figure 22:
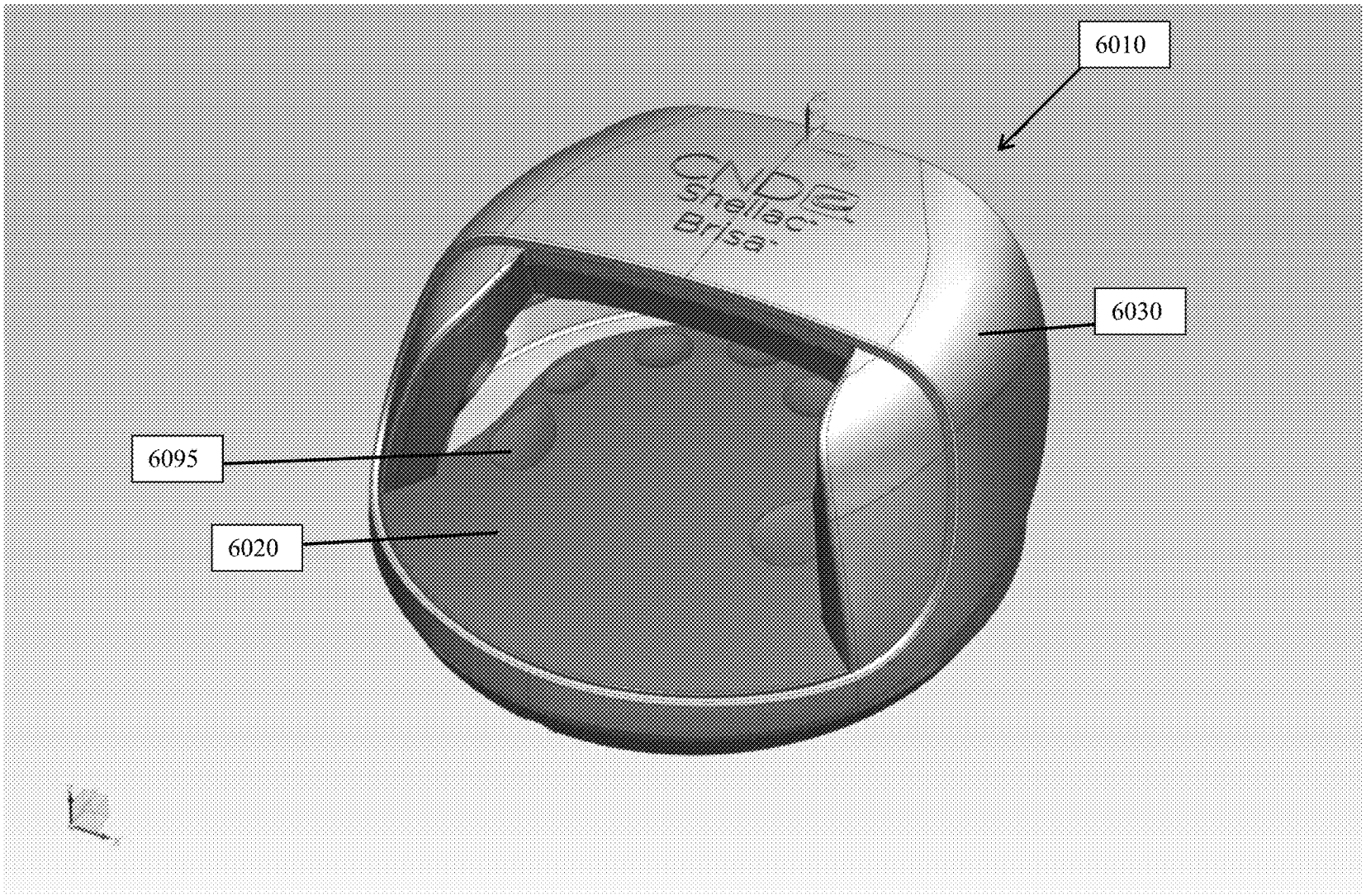
FIG. 22 is a top rear perspective view of a nail lamp according to another embodiment.
Figure 23:
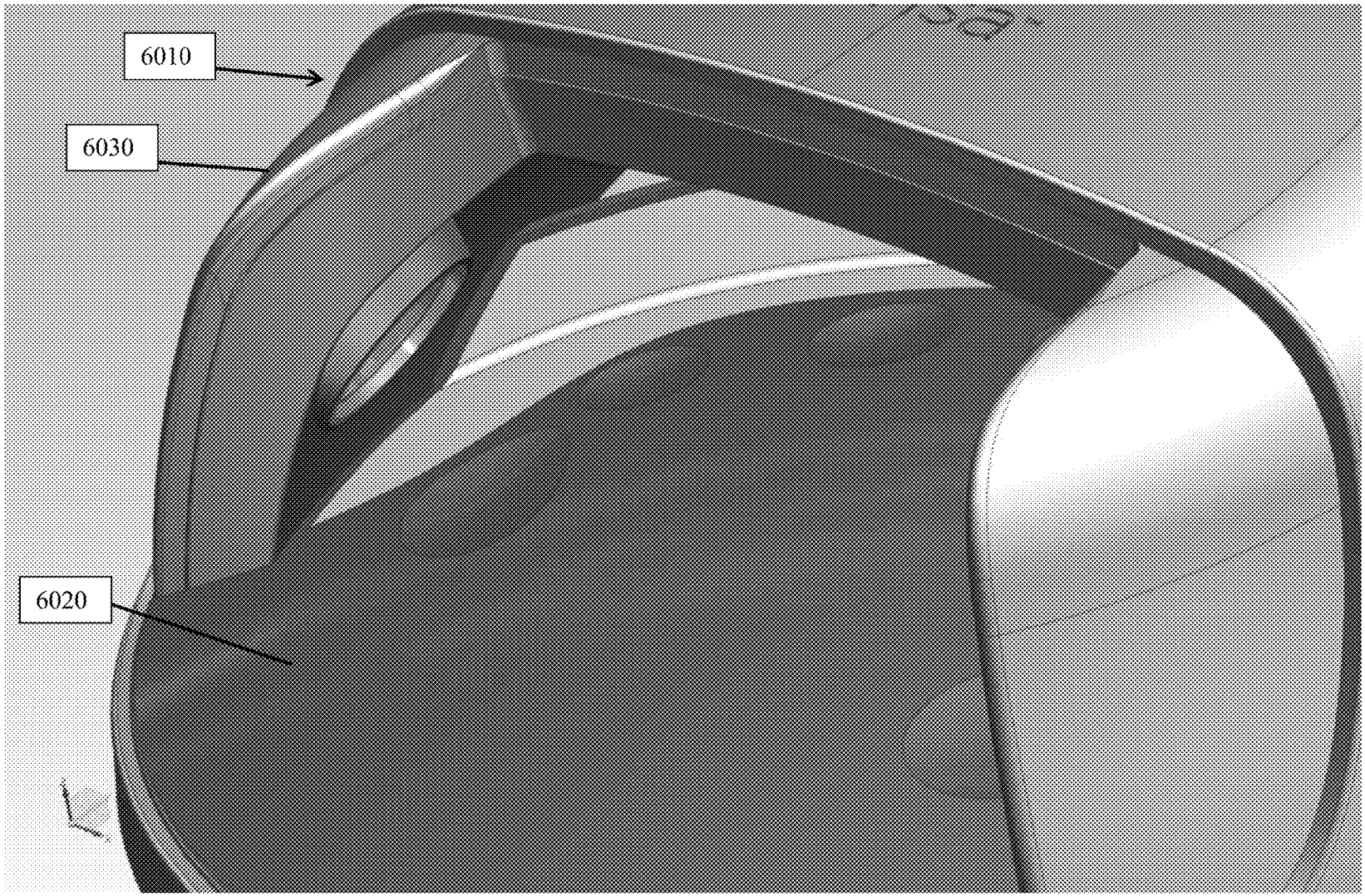
FIG. 23 is a zoomed top rear perspective view of the nail lamp of FIG. 22.

FIG. 21 illustrates a nail lamp 5010 according to an alternative embodiment of the present invention. To avoid redundant description, components of the lamp 5010 that are similar to components of the lamps 10, 1010, 2010, 3010, 4010 are identified using comparable reference numbers in the 5000 range. The lamp 5010 is generally similar to the lamps 10, 1010, 2010, 3010, 4010, except that the lamp 5010, its support 5030, its base (not shown), its space 5110, and its light sources 5050 are configured to simultaneously accommodate all ten nails on both appendages (hands or feet) of the user so as to simultaneously cure the nail product on all ten side-by-side nails. As shown in FIG. 17, two clusters 5130, 5190 of lights 5050 divide the space 5110 into left and right sides for the user's left and right appendages, respectively. The clusters 5130, 5190 are positioned to direct light from their light sources 5050 toward the user's left and right thumb nails, respectively. The clusters 5130, 5190 may be angled (e.g., at a 30°, 45°, or 60° angle) so as to more squarely direct light onto the user's thumb nails. The two-appendage, ten nail feature of the lamp 4010 may be incorporated into any of the other lamps 10, 1010, 2010, 3010, 4010 without deviating from the scope of the invention.

In the lamps 10, 1010, 2010, 3010, 4010, 5010, the various light sources and light clusters are preferably positioned to provide a similar light-source-to-nail gap, light-source-to-nail light intensity, and light-source-to-nail angle of incidence (for example about 90° so that the light squarely hits the surface of the nails) for each of the user's nails. According to various embodiments, such consistency across the different clusters provides for more uniform curing of the nail product on the user's different nails.

FIGS. 22-29 illustrate a nail lamp 6010 according to another aspect of the present invention. To avoid redundant descriptions, components of the lamp 6010 that are similar to components of the lamps 10, 1010, 2010, 3010, 4010, and 5010 are identified using comparable reference numbers in the 6000 range (e.g., base 6020 corresponds to base 20 in lamp 10). The lamp 6010 includes a base 6020, a support 6030, a light source 6050, and a reflector 6260.

Figure 26:
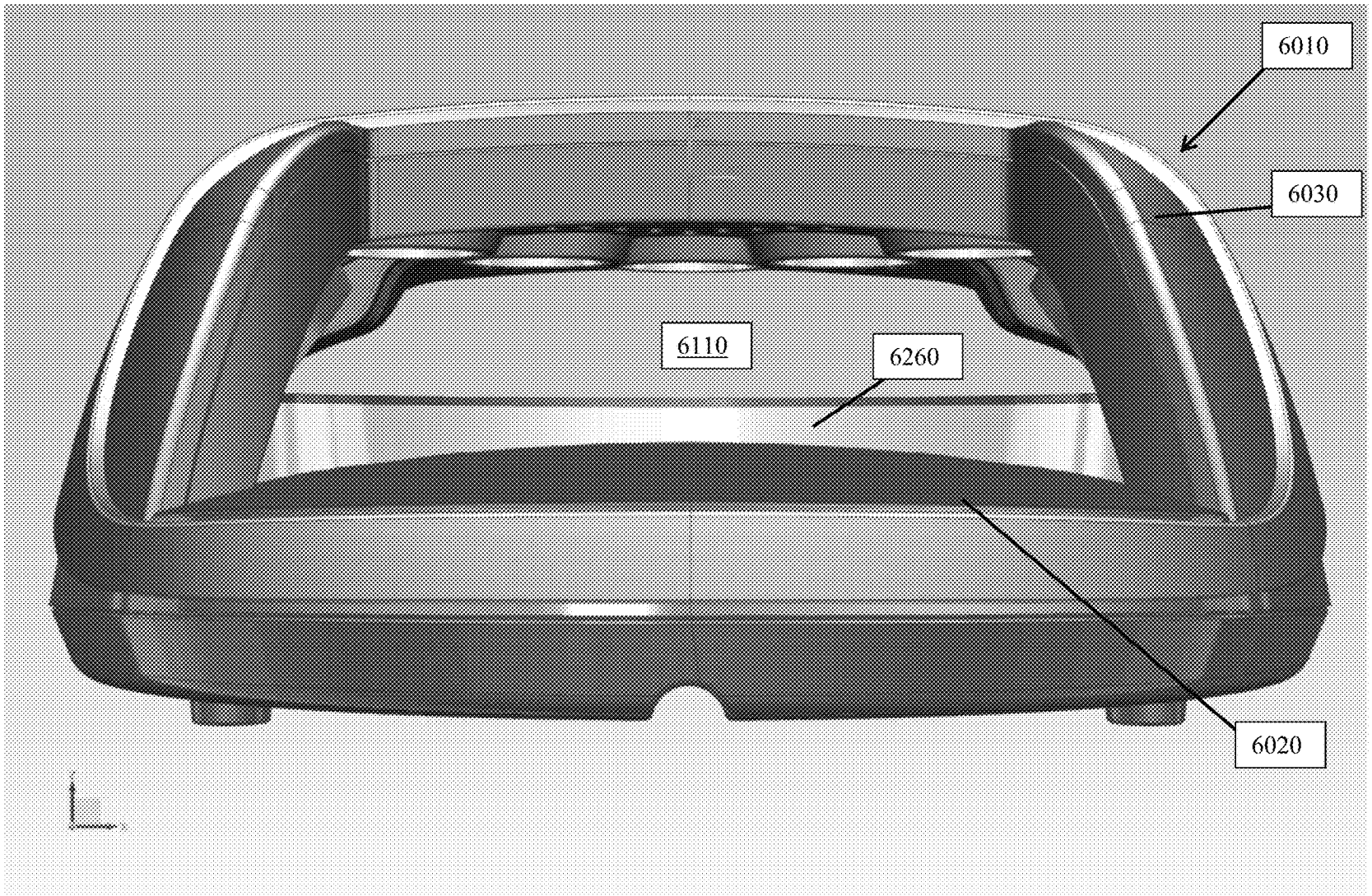
FIG. 26 is a rear view of the nail lamp of FIG. 22.
Figure 29:
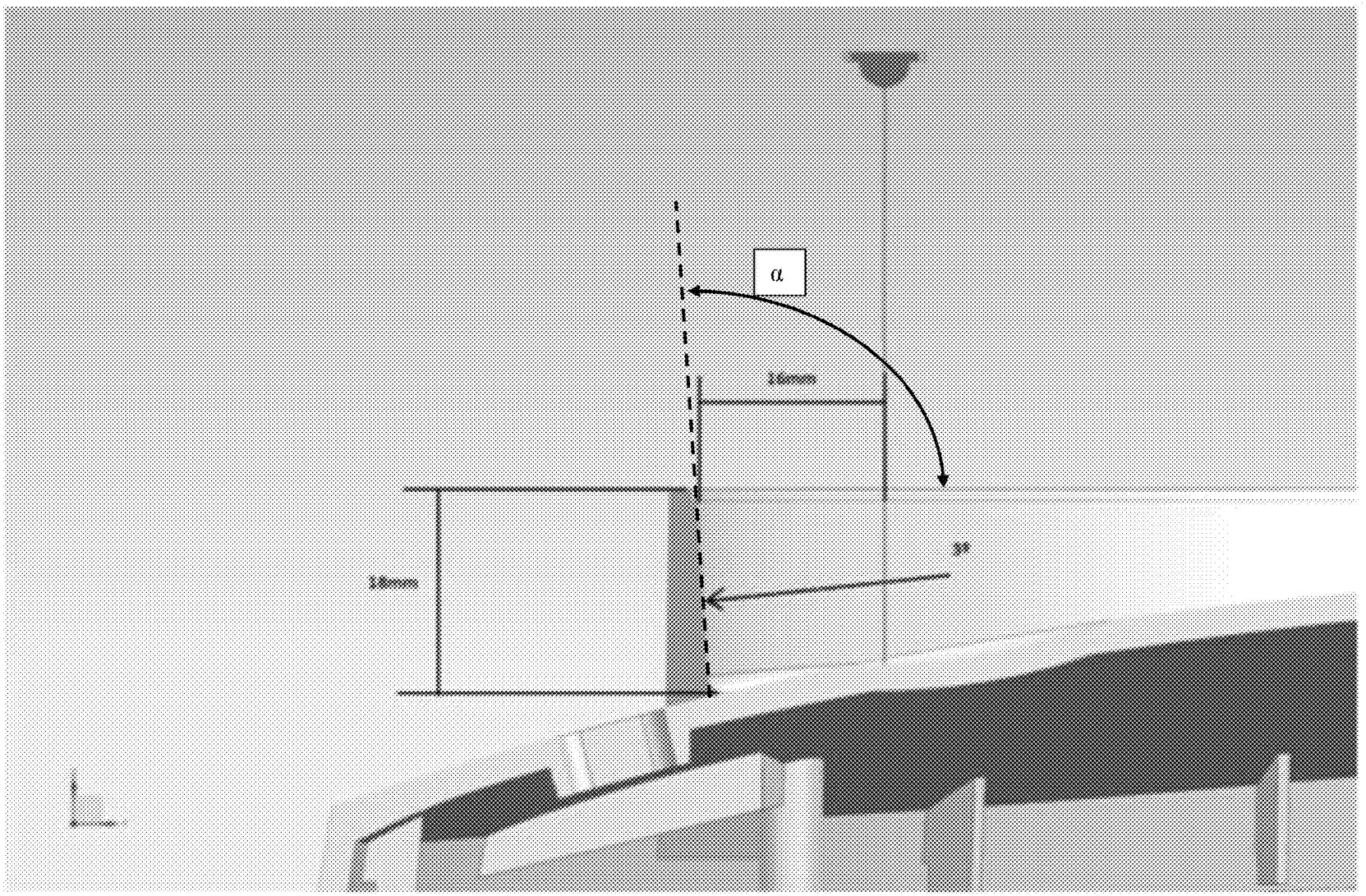
FIG. 29 is a cross section of the reflector and base of the nail lamp of FIG. 22.
Figure 30:
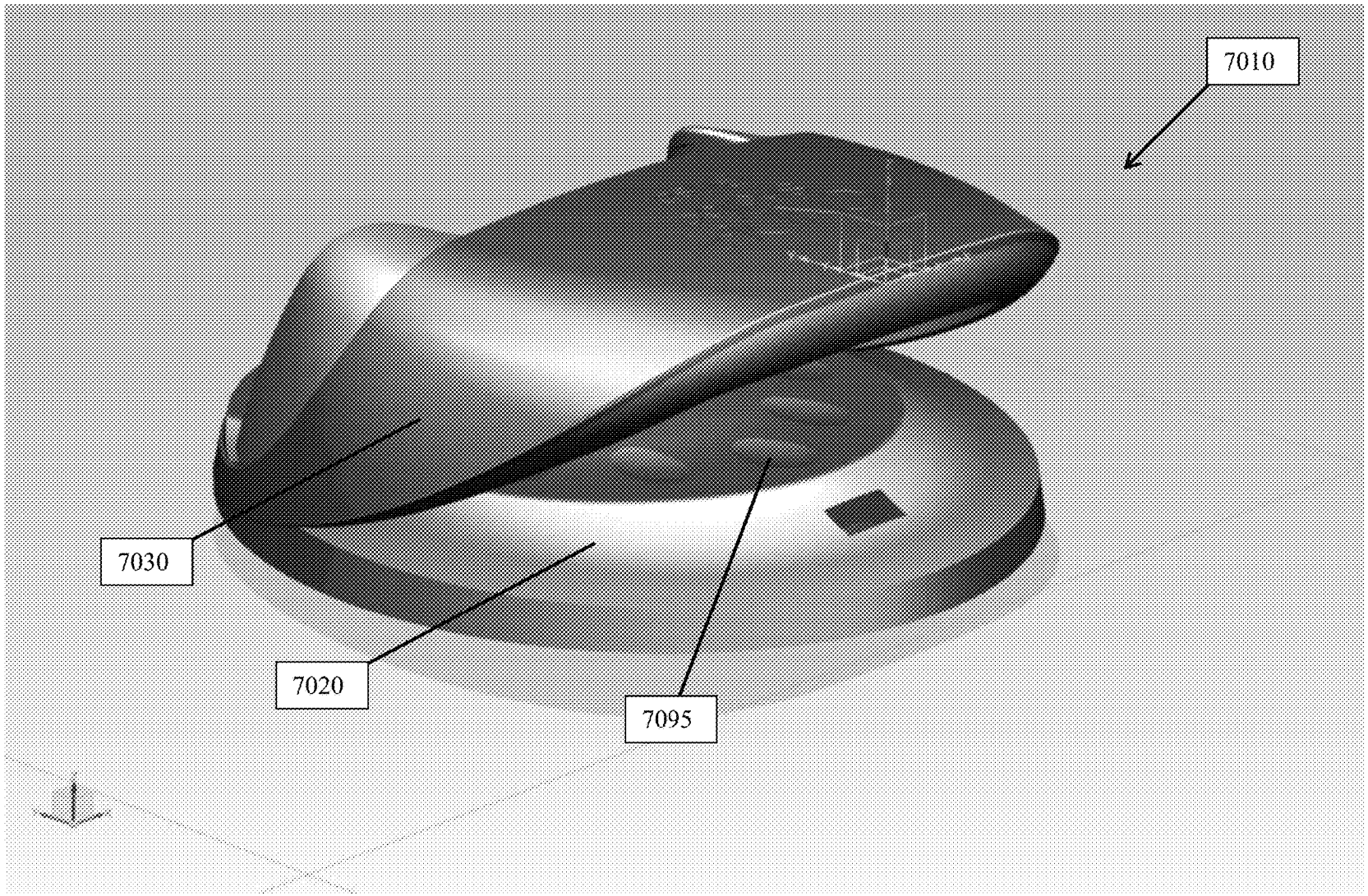
FIG. 30 is a top front perspective view of a nail lamp according to another embodiment.
Figure 31:
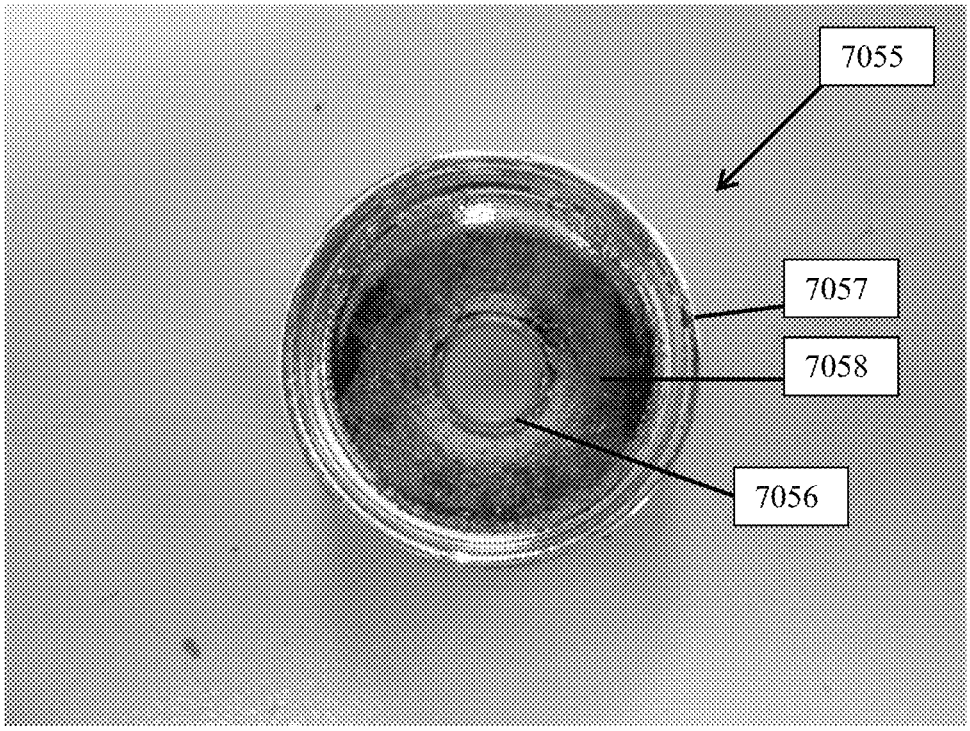
FIG. 31 shows a source reflector with both the small end and large end having circular openings.

The support 6030 of the lamp 6010 is connected to the base 6020 such that the support 6030 is in its operative position and a space 6110 between the base 6020 and the support 6030 is sized to accommodate a user's appendage. The space 6110 is open to an ambient environment at a rear portion 6110*a* of the space 6110. The space 6110 may additionally be open to the ambient environment at a front, a left, and/or a right portion of the space 6110. The base 6020 may be flat or may have a convex shape, as depicted in FIGS. 26 and 29.

Figure 24:
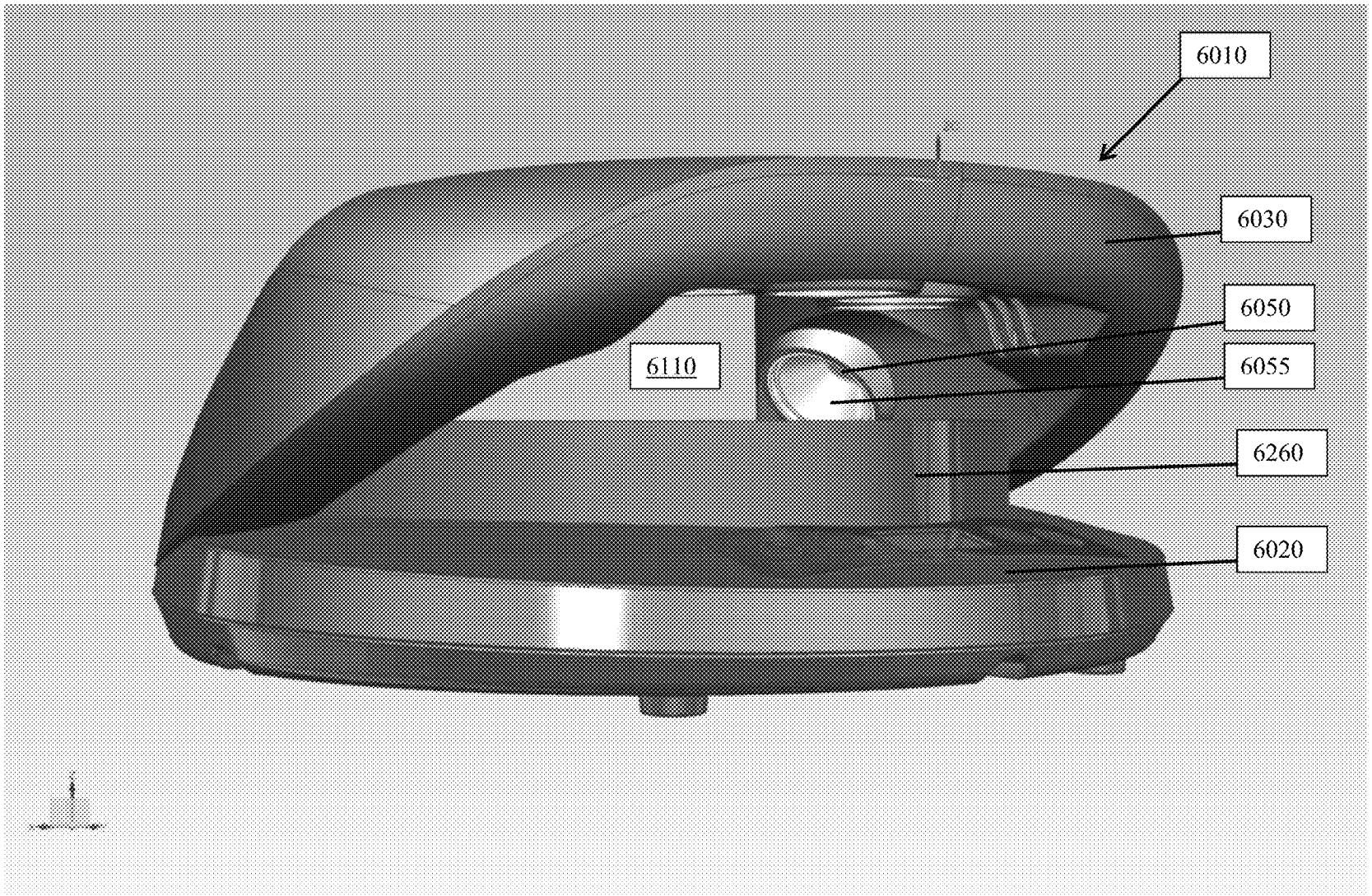
FIG. 24 is a front perspective view of the nail lamp of FIG. 22.
Figure 25:
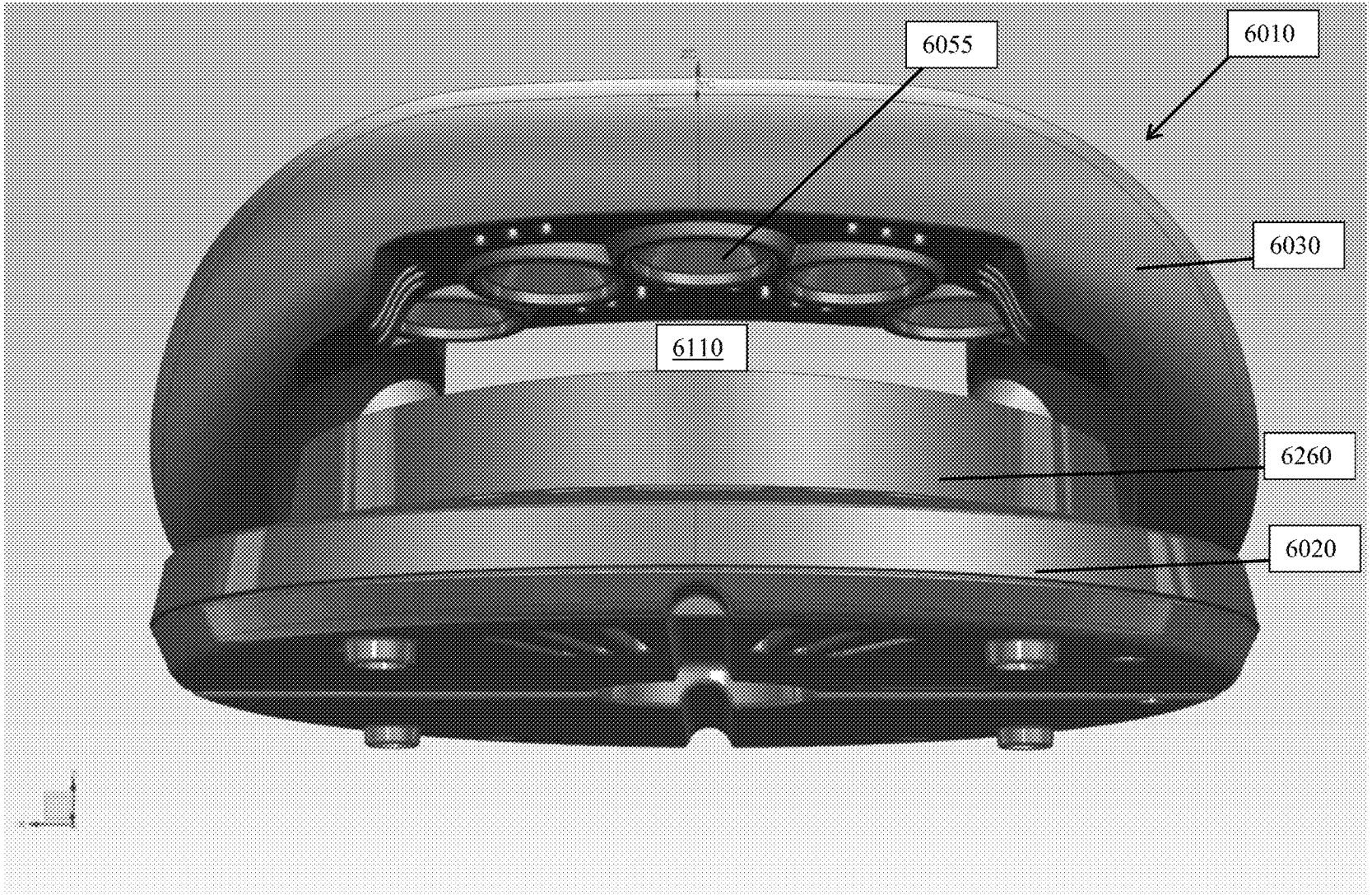
FIG. 25 is front view of the nail lamp of FIG. 22.

A light source 6050 is disposed within the support 6030 of the lamp 6010. The light source 6050 is configured to produce light to cure a light-curable nail product, and the light source 6050 is positioned to direct the light onto a nail of the user's appendage. The light source 6050 may be a single lighting element, or it may include a plurality of lighting elements. For example, the light source 6050 may be a single LED device, or may include multiple LED devices. While FIG. 24 shows a source reflector 6055 arranged within the support 6030 around the light source 6050, the source reflector 6055 is optional and is described in more detail below.

In one embodiment, a plurality of light sources 6050 may be arranged in the support 6030. For example, the lamp 6010 may include two, three, four, or more light sources 6050. In the embodiment shown in FIG. 25, a light source 6050 corresponding to each of five nails of the user's appendage is shown. As described above, each of the plurality of light sources 6050 may include a single LED device or multiple LED devices.

In another embodiment, the lamp 6010 may be configured to receive five nails of any of the user's hands and feet. The lamp 6010 may include a light source 6050 corresponding to each nail of a left appendage or a right appendage of the user. In this configuration, the lamp 6010 may include a total of seven (7) light sources 6050: one light source for each of the user's left and right thumb nails and left and right pinky finger nails, a common light source for the user's left ring finger nail and the user's right index finger nail, a common light source for the user's left and right middle finger nails, and a common light source for the user's left index finger nail and the user's right ring finger nail, for example.

While the above embodiments describe configurations for only one appendage, in another embodiment the lamp 6010 may be configured to accept two appendages. In this example embodiment, rather than the common configuration just described for the three central nails of the user, ten (10) light sources 6050 may be included, one for each nail, where each light source 6050 corresponds to an individual nail of each finger/toe of the user.

The lamp 6010 includes a reflector 6260 connected to a top surface of the base 6020. The reflector 6260 is arranged in an arc-shape between a left portion 6020*a* of the base 6020 and a right portion 6020*b* of the base 6020. Such an arrangement allows the reflector 6260 to reflect the light produced by the light source(s) 6050 to a front edge portion of the user's nail(s) as well as an underneath portion of the nail(s). The reflector 6260 may be arranged in a position that is offset from a perimeter of the base 6020, as shown in FIG. 28, or alternatively, may be arranged at the perimeter of the base 6020 (not shown).

Figure 27:
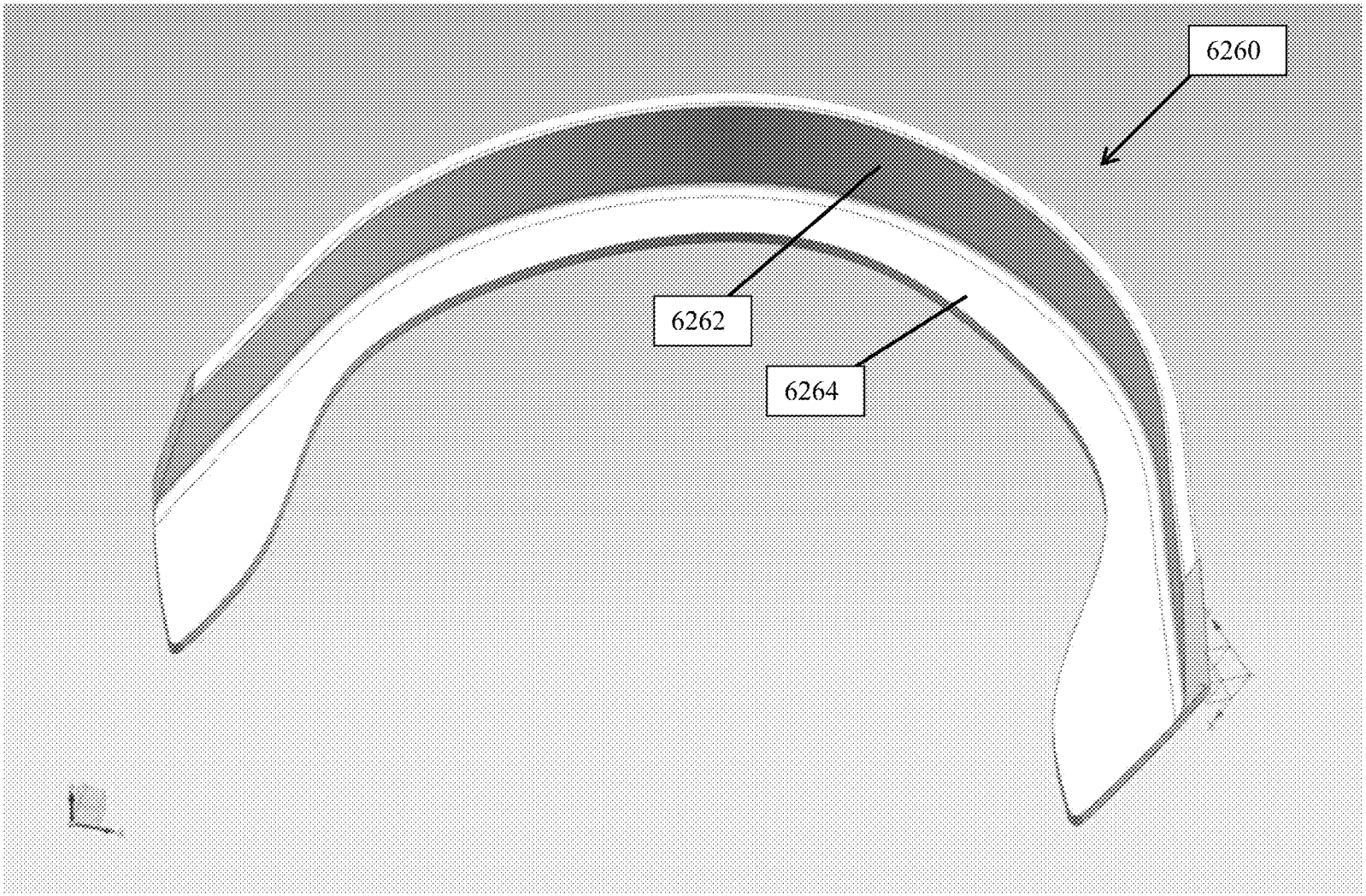
FIG. 27 is a top perspective view of a reflector of the nail lamp of FIG. 22.

The reflector 6260 may be made of a plastic material, a metallic material, and/or any other type of suitably rigid material. For example, the reflector 6260 may be made of a plastic material and coated with a metallic layer having a polished finished to enhance its reflectivity. The reflector 6260 may include a wall portion 6262 and optionally a base portion 6264, as shown in FIGS. 27 and 28. The base portion 6264 enhances curing of the nail product at the underneath portion of the nail(s).

The wall portion 6262 may be substantially perpendicular (i.e., at 90°) to the base portion 6264, or alternatively, may be at an angle $\alpha$ smaller or larger than 90° relative to the base portion 6264. In one embodiment, the wall portion 6262 is inclined at an angle of about 90° to 100° relative to a surface of the base portion 6264, such that a top edge of the wall portion is inclined away from a central region 6020*c* of the base 6020, as shown in FIG. 29. The wall portion 6262 may, in another embodiment, be at an angle of about 85°-90° relative to a surface of the base portion 6264 such that a top edge of the wall portion is inclined towards a central region 6020*c* of the base 6020. For example, the angle may be approximately 93° relative to the surface of the base portion 6264. Optimization of the angle of inclination $\alpha$ may be achieved by varying a height of the wall portion 6262, a width of the base portion 6264, and/or a distance of the wall portion 6262 from the nail(s). In an embodiment, the height of the wall portion 6262 is taller than a height of the user's finger(s)/toe(s). For example, the reflector 6260 is positioned approximately 16 mm from an edge of the nail(s) and has an approximate height of 18 mm.

Figure 28:
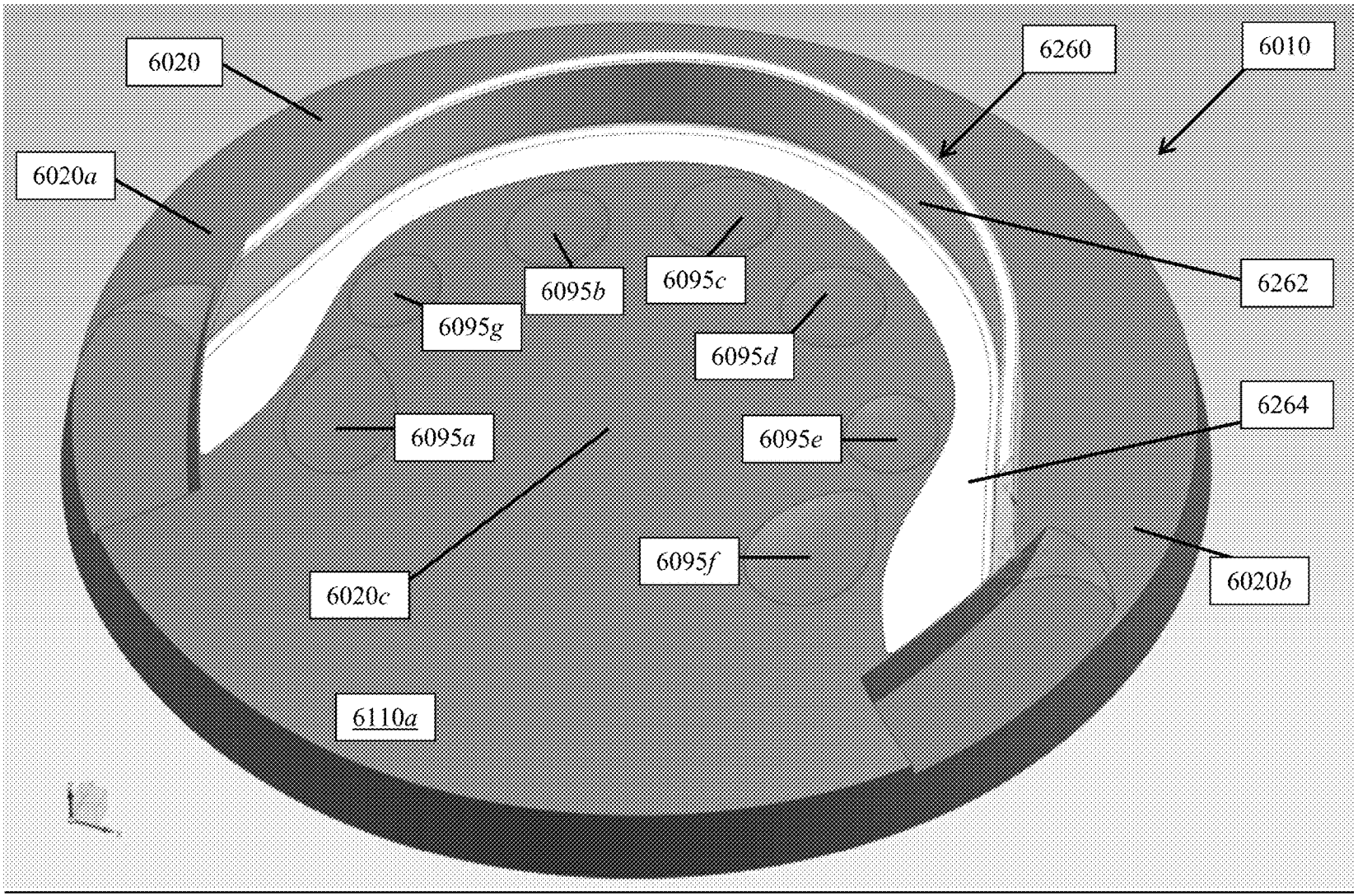
FIG. 28 is a top rear perspective view of a reflector and base of the nail lamp of FIG. 22.

In yet another embodiment, as shown in FIG. 28, the base 6020 may include position indicators 6095*a*, 6095*b*, 6095*c*, 6095*d*, 6095*e*, 6095*f*, 6095*g* (collectively "position indicators 6095"). The position indicators 6095 may be represented by an indentation, a protrusion, a marking, and/or any other type of suitable means to indicate a desired nail position. Each position indicator 6095 corresponds to a nail of a right appendage and/or a nail of a left appendage. Position indicators 6095*a*, 6095*b*, 6095*c*, 6095*d*, 6095*e* correspond to a thumb, index, middle, ring, and pinky finger of the user's right hand, respectively, for example. Position indicators 6095*f*, 6095*d*, 6095*c*, 6095*b*, 6095*g* correspond to a thumb, index, middle, ring, and pinky finger of the user's left hand, respectively, for example For the sake of simplicity, the descriptions herein will refer to nails on the user's hands. As will be understood by skilled artisans, the position indicators could also be analogously arranged for toes on the user's foot/feet.

More specifically, as shown in FIG. 28 and as just described, central ones of the position indicators 6095*b*, 6095*c*, 6095*d* are common for both the left and right hands (i.e., the three central nails of the left and right hands). The right-most position indicator for the right hand 6095*e* is positioned closer to a front portion of the base 6020 the right-most position indicator for the left hand 6095*f* Similarly, the left-most position indicator for the left hand 6095*g* is positioned closer to the front portion of the base than the left-most position indicator for the right hand 6095*a*.

The base portion 6264 of the reflector 6260 may be a uniform width from the left side of the base 6264 to the right side of the base 6264. Alternatively, the base portion 6264 of the reflector 6260 may be wider at its ends (i.e., at a position approximate position indicators 6095*a*, 6095*f*) and may be narrower in a central region (i.e., at a position approximate position indictors 6095*b*, 6095*c*, 6095*d*). The wider base portion 6264 provides more efficient and uniform curing of the left and right thumb nails positioned at position indicators 6095*a*, 6095*f*.

FIGS. 30-36 illustrate a nail lamp 7010 and associated components according to another aspect of the present invention. To avoid redundant descriptions, components of the lamp 7010 that are similar to components of the lamps 10, 1010, 2010, 3010, 4010, 5010, and 6010 are identified using comparable reference numbers in the 7000 range (e.g., base 7020 corresponds to base 20 in lamp 10).

The lamp 7010 is similar to the lamp 6010, except the lamp 7010 does not include a reflector such as the reflector 6260. Additionally, the lamp 7010 includes a source reflector 7055. The lamp 7010 includes a base 7020, a support 7030, a light source 7050, and a source reflector 7055.

The source reflector 7055 is arranged within the support 7030 around the light source 7050. The source reflector 7055 may be made of a plastic material, a metallic material, and/or any other type of suitably rigid material. For example, the source reflector 7055 may be made of a plastic material and coated with a metallic layer having a polished finished to enhance reflectivity.

Figure 32:
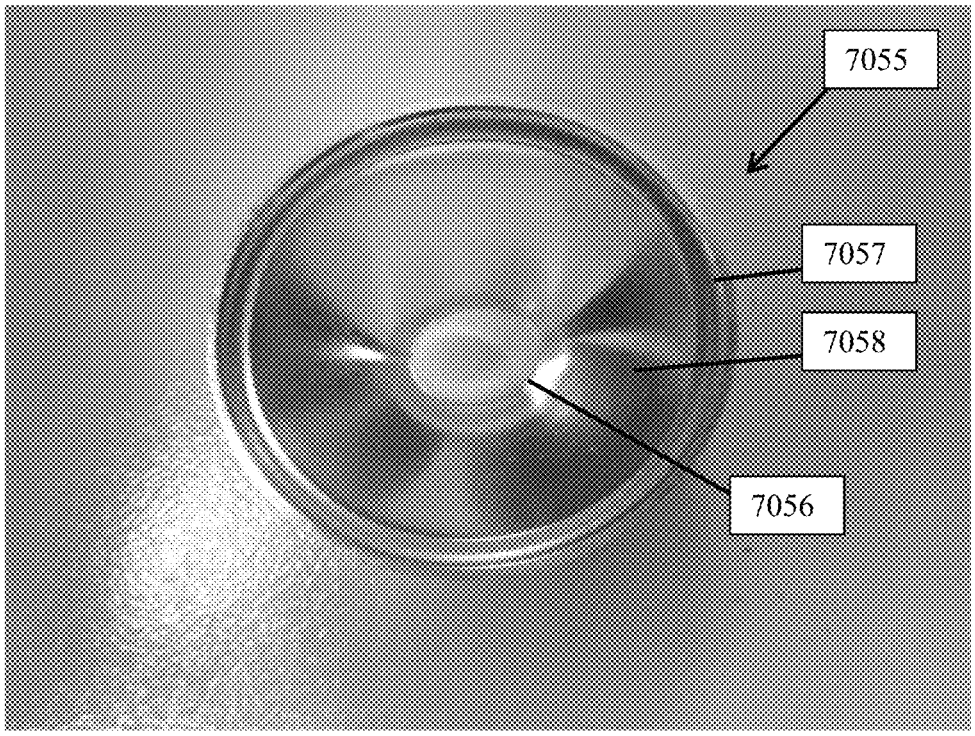
FIG. 32 shows a source reflector with both the small end and large end having oval openings.
Figure 33:
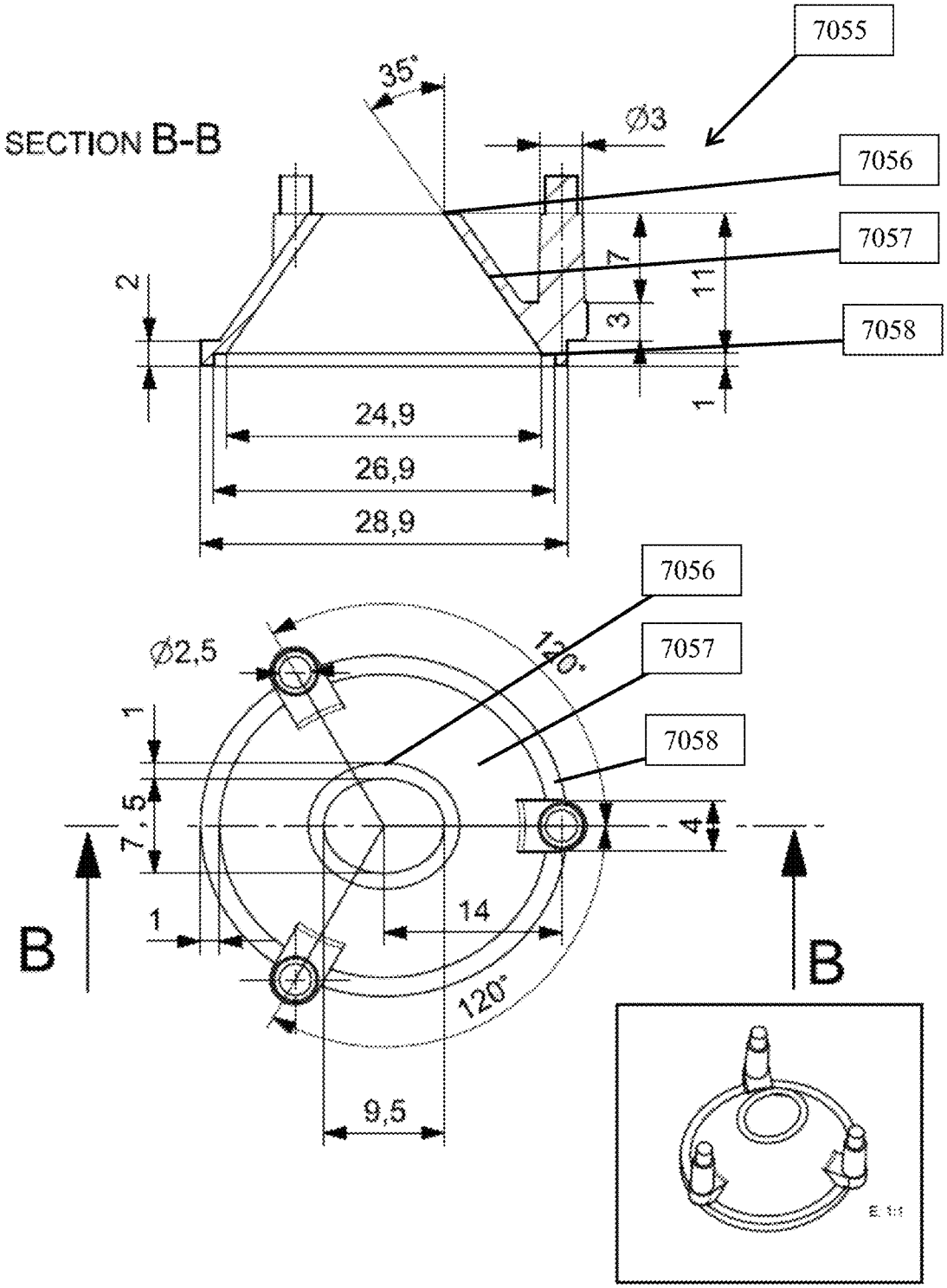
FIG. 33 shows the dimensions of a source reflector according to a particular embodiment.
Figure 34A:
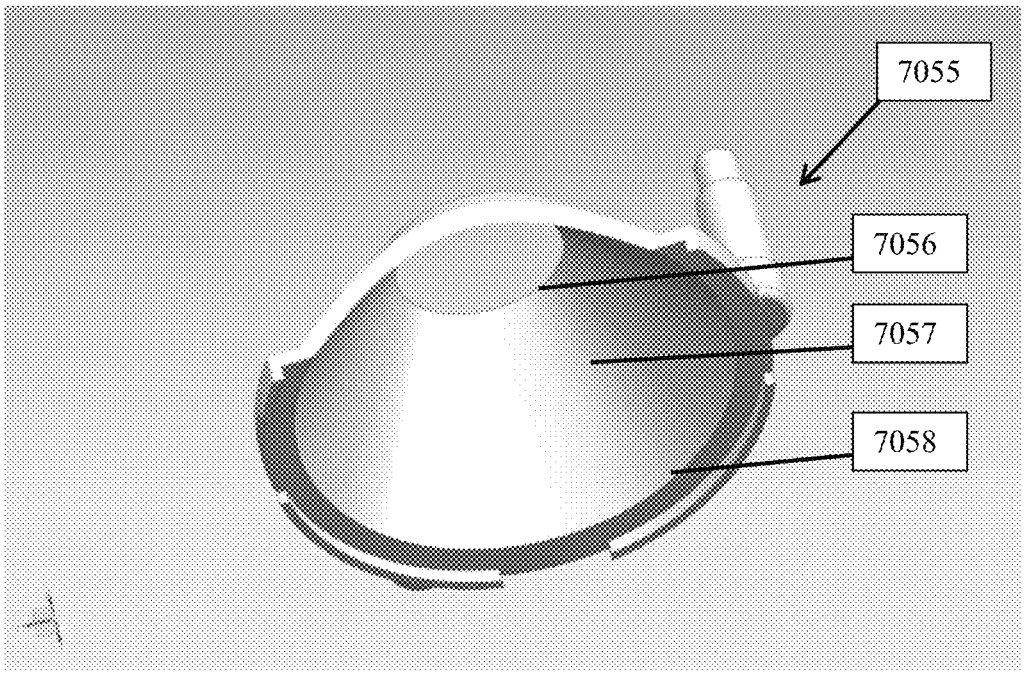
FIGS. 34A and 34B show a source reflector with both the small end and large end having oval openings.
Figure 34B:
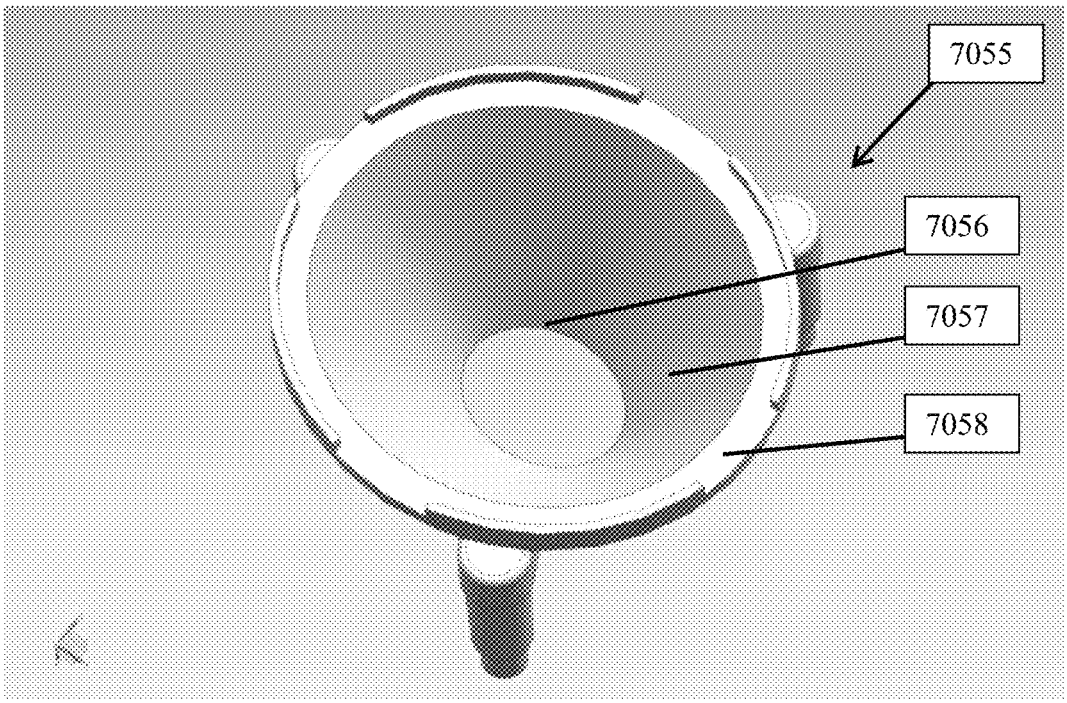
Figure 35:
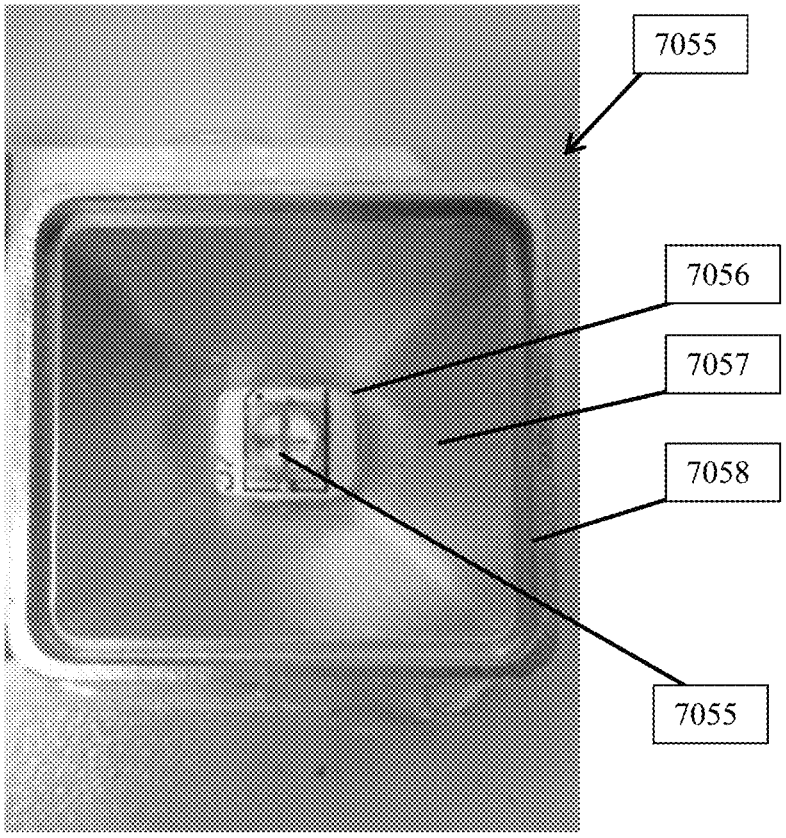
FIG. 35 shows a source reflector with both the small end and large end having rectangular openings.
Figure 36A:
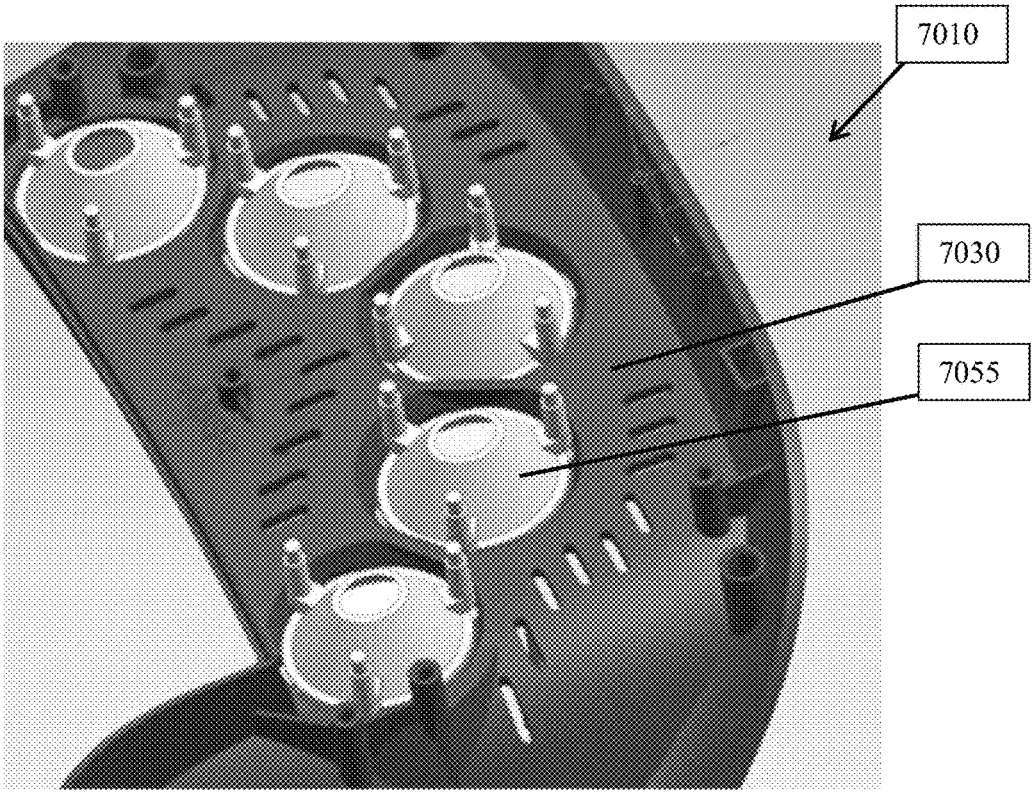
FIG. 36A shows the inside of the support in which the source reflectors are arranged.
Figure 36B:
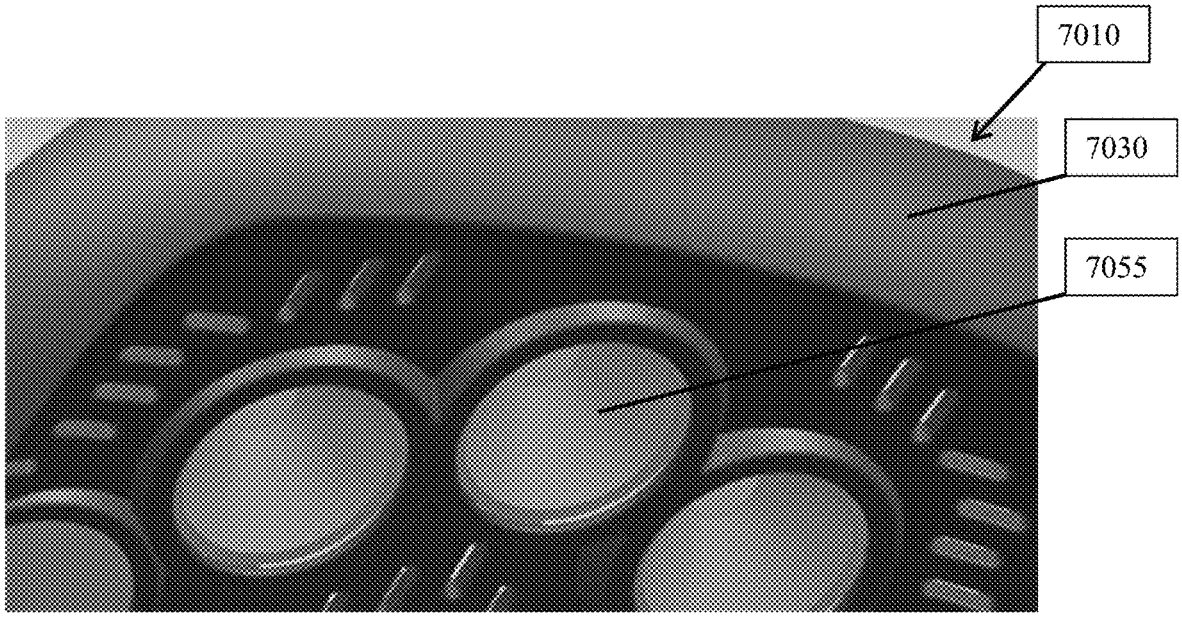
FIG. 36B shows the source reflectors arranged within the support.

The source reflector 7055 is structured to direct the light from the light source 7050 onto a corresponding nail within a space 7110 between the base 7020 and the support 7030. The source reflector 7055 may be designed as a frustum reflector, with a small end 7056 and a large end 7057, as shown in FIG. 34. Each of the small end 7056 and large end 7057 of the source reflector 7055 may have openings shaped as one of (i) an oval, (ii) a circle, (iii) a square, (iv) a rectangle, (v) an ellipse, and (vi) a polygon. Other shapes may also be used for the openings. FIG. 32 shows a source reflector 7055 with circular openings, FIGS. 33-35 show a source reflector 7055 with oval openings, and FIG. 36 shows a source reflector 7055 with rectangular openings. While FIG. 36 is the only illustration depicting the light source 7050 in conjunction with the source reflector 7055, it should be understood that the light source 7050 is similarly arranged in FIGS. 30-35.

A wall 7058 of the source reflector 7055 may be inclined at an angle β between about 20° and about 50° relative to a vertical position from the small end of the source reflector 7055. For example, the wall 7058 is inclined at an angle β of approximately 35° relative to the vertical position, and the source reflector 7055 has a vertical height of 11 mm. This arrangement focuses the light from the light source 7050 and directs the light to a corresponding nail within the space 7110. It should be understood that optimal values for the height of the source reflector 7055, the shape of the reflector openings, and the angle of inclination β are based on the dimensions of the light source 7050, a light disbursement angle of the light source 7050, and distance from the nail(s).

In an embodiment, the source reflector 7055 has an opening at the small end 7056 shaped as an oval and an opening at the large end 7057 shaped as an oval. The small end 7056 has a minor axis measuring approximately 7.5 mm and a major axis measuring 9.5 mm, and the large end 7057 has a minor axis measuring approximately 23 mm and a major axis measuring approximately 25 mm. The table below shows examples of light intensity outputs (at 250 mA) for oval source reflectors 7055 of different dimensions.

| Shape | Wall Angle | Height | Small End Minor | Small End Major | Large End Minor | Large End Major | Output (microwatts/cm$^2$) |
|---|---|---|---|---|---|---|---|
| Oval 1 | 38.5 | 11 | 7.5 | 9.5 | 25 | 27 | 226.32 |
| Oval 1-2 | 38.5 | 11 | 7.5 | 9.5 | 25 | 27 | 212.79 |
| Oval 2 | 37 | 11 | 7.5 | 9.5 | 24 | 26 | 258.3 |
| Oval 3 | 35 | 11 | 7.5 | 9.5 | 23 | 25 | 319.8 |
| Oval 3-2 | 35 | 11 | 7.5 | 9.5 | 23 | 25 | 309.96 |
| Oval 4 | 36 | 11 | 7.5 | 9.5 | 23.5 | 25.5 | 275.52 |
| Oval 3B | 35 | 11 | 7.5 | 10.5 | 23.5 | 25.5 | 292.74 |
| Oval 3C | 35 | 13 | 7.5 | 9.5 | 25.7 | 25.7 | 264.45 |

FIGS. 37A-E illustrate an LED device 8050 useable as a light source in a nail lamp of embodiments of the present invention.

Figure 37B:
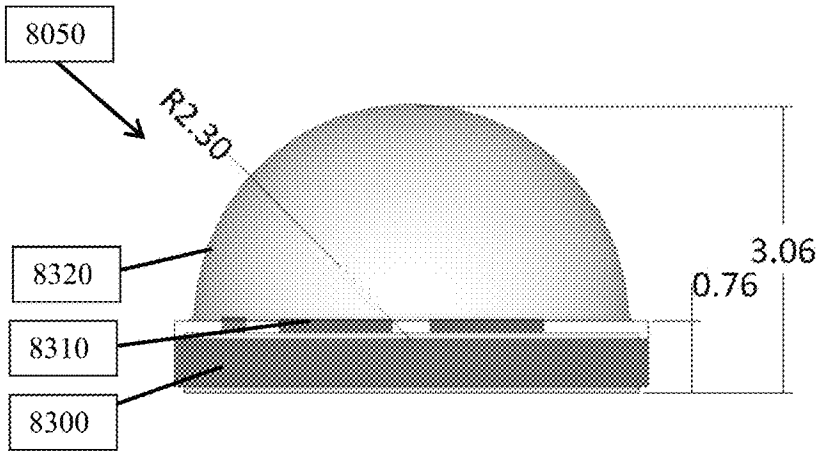
FIGS. 37A-E show an LED device according to a particular embodiment.
Figure 37C:
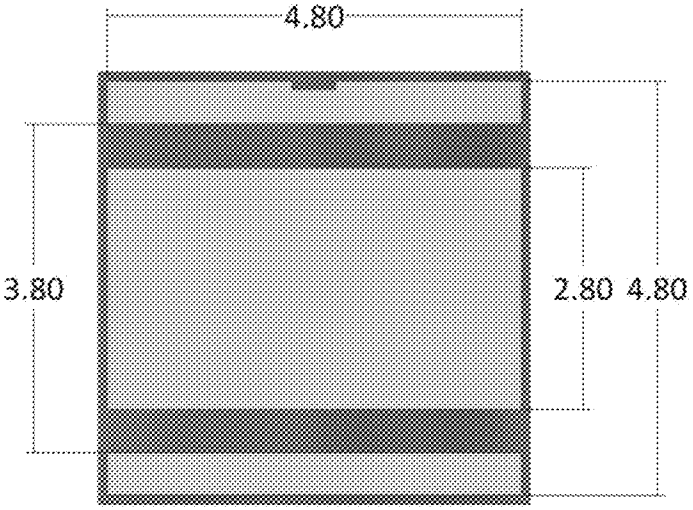
Figure 37A:
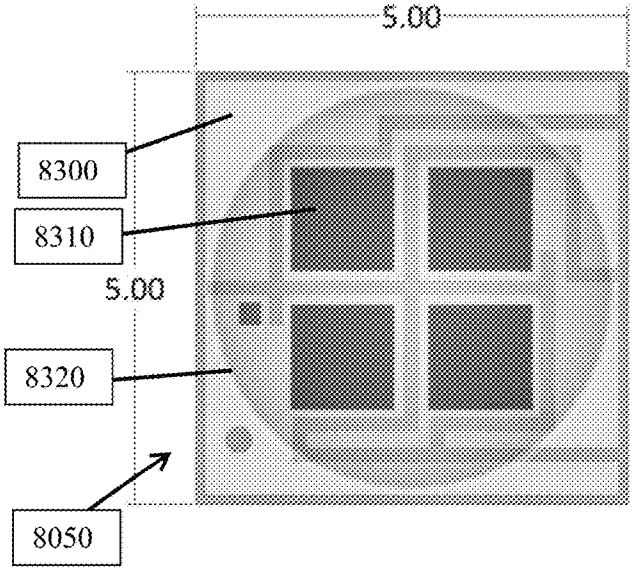
Figure 37D:
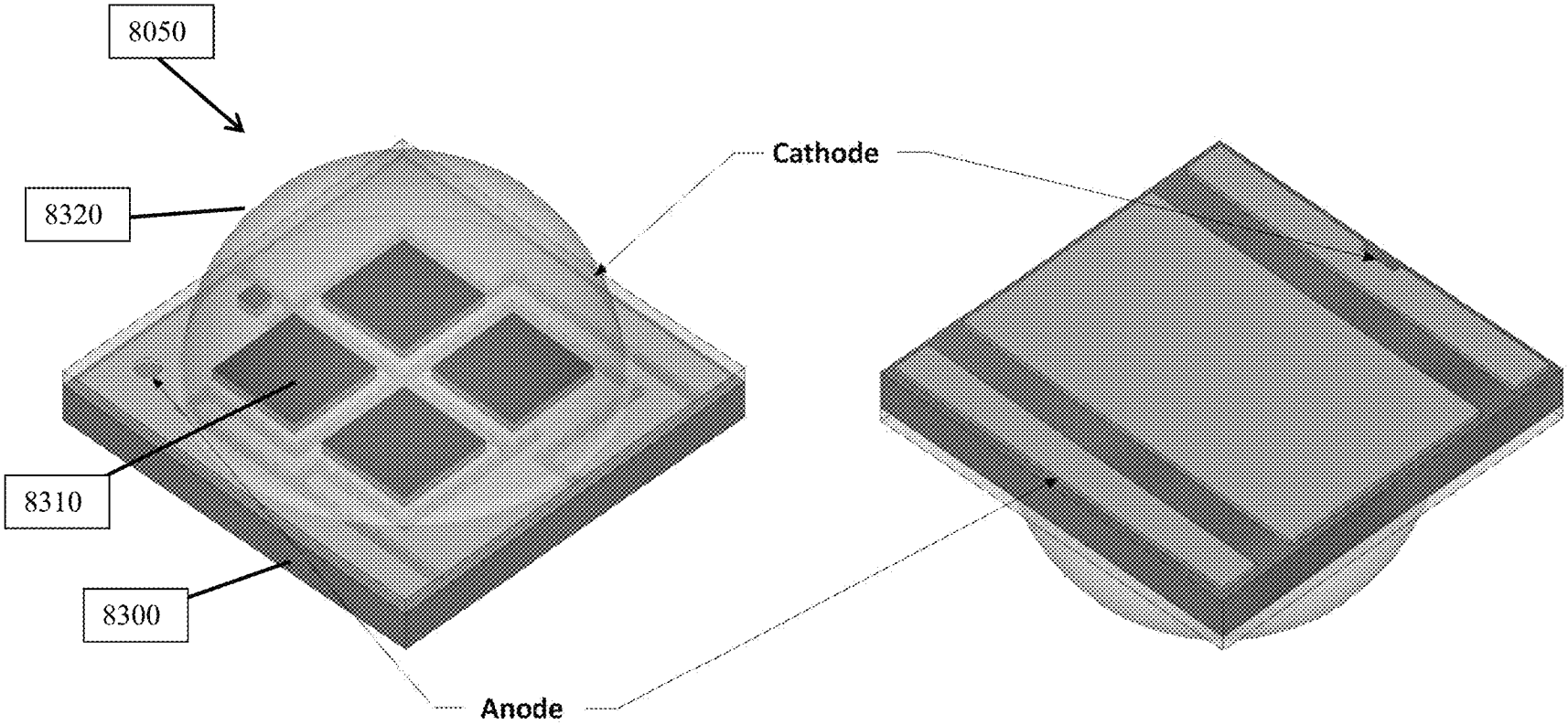
Figure 37E:
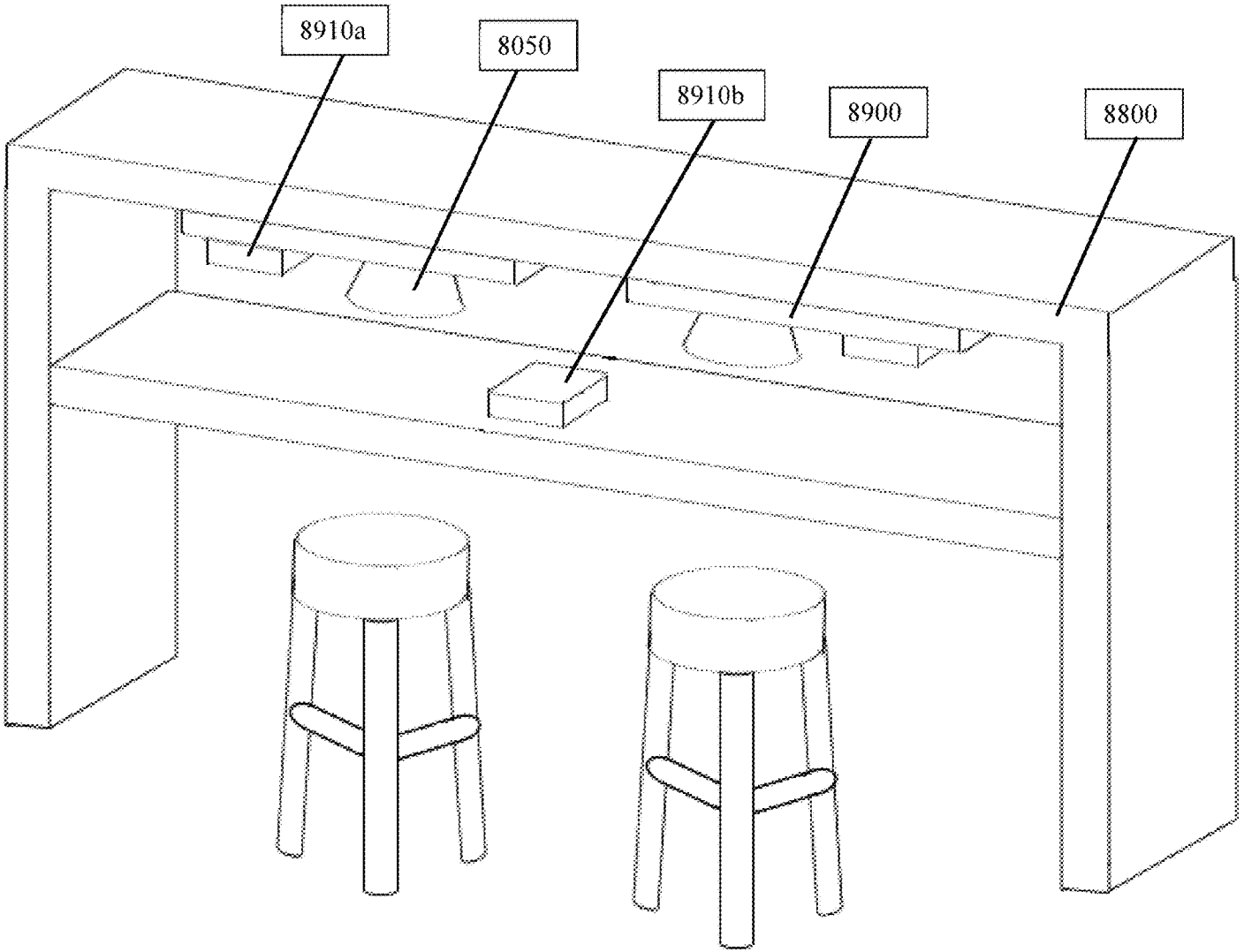

In one embodiment, as shown in FIG. 37E, the nail lamp includes an LED device 8050, a light source support 8900, and a controller 8910*a*, 8910*b*. The LED device 8050 is arranged within the light source support 8900, and the controller 8910*a* may be arranged on the light source support 8900 or the controller 8910*b* may be external to the light source support 8900, such as a wired or wireless controller. The light source support 8900 may be connectably mountable to the underside of a piece of furniture 8800, for example, a shelf on table, desk, and the like. The light source support 8900 may be connectably mountable through the use of an external mount, screws, clamps, adhesives, or any other connecting hardware or material.

In another embodiment, the light source support 8900 may be connected to a nail lamp base, such as the nail lamp embodiments described herein, particularly the lamps 6010 and 7010. The LED device 8050 may be a multiple-wavelength LED device.

The LED device 8050 includes a circuit board 8300 with a plurality of semiconductor chips 8310 coupled thereto. While four semiconductor chips 8310 are shown on the circuit board 8300 in FIGS. 37A and 37D, the LED device 8050 may have a different number of chips or a single chip 8310. In the embodiment shown in FIGS. 37A-D, four chips 8310 are coupled to the circuit board 8300. The four chips 8310 and the circuit board 8300 are at least partially covered by a protective encapsulant or lens 8320. For example, the lens 8320 covers at least the four semiconductor chips 8310. The lens 8320 may be made of a transparent material, such as plastic, glass, and the like, in order to protect the chips 8310. The lens 8320 may be hemispherically shaped with a large light disbursement or beam angle (e.g., a 135° disbursement angle), or may alternatively be a cylindrically shaped with a domed end, which has a lower light disbursement or beam angle (e.g., a 65° disbursement angle).

In an embodiment, at least one of the chips 8310 has a peak electromagnetic emission intensity at a wavelength of approximately 380-390 nm, and at least one of the chips 8310 has a peak electromagnetic emission intensity at a wavelength of approximately 395-415 nm. The lower wavelength chip(s) 8310 (i.e., the 380-390 nm chip(s)) is/are suitable for surface curing of a particular type of light-curable nail product, whereas the higher wavelength chip(s) 8310 (i.e., the 395-415 nm chip(s)) is/are suitable for bulk curing of that type of light-curable nail product. Thus, when at least one 380-390 nm chip 8310 and at least one 395-415 nm chip 8310 are utilized in the nail lamp embodiments described herein, that type of light-curable nail product can be cured efficiently. The four chips 8310 may include a combination of one 380-390 nm chip and three 395-415 nm chips, two 380-390 nm chips and two 395-415 nm chips, or three 380-390 nm chips and one 395-415 nm chip.

While the above embodiment is described to include 380-390 nm and 395-415 nm chips, it should be understood that the LED device 8050 may have chips emitting at other wavelengths suitable for curing light-curable nail products of different types. In addition, and as discussed above, while four chips are described, the LED device 8050 may include two, three, four, five, etc., chips. For example, the LED device 8050 may include eight chips, with the chips emitting at some combination of 365 nm, 375 nm, 385 nm, 395 nm, 405 nm, 415 nm, 425 nm, etc., wavelengths.

The LED devices 8050 just described may be, for example, those available from SemiLEDs Corp. (Taiwan) as model number N5050U-UNL2-A1G41H (hemispherical) or model N505OU-UNF2-A1G41H (cylindrical with dome-shaped end). The LED devices 8050 may include chips all having the same peak intensity wavelength, or may include semiconductor chips having different peak intensity wavelengths.

The LED device 8050 is connected to and controlled by an electronic controller (not shown). A controller interface is included on the nail lamp (e.g., 6010, 7010, 8010) to enable an operator to input instructions to the controller. The controller interface may include any combination of control buttons, a control dial, a digital input pad, and the like, located on the base or another location of the nail lamp. The controller may be a CPU programmed to alter the emission intensities of the LED device(s) 8050 by controlling current to the LED device(s) 8050. For example, the controller may be used to set the LED device(s) 8050 to a 100% intensity, an intermediate intensity (e.g., 40%, 50%, 60%, 75%, 90%), or no intensity at all (e.g., an "off" state). The controller may control the LED device(s) 8050 as a whole (i.e., all four chips 8310 simultaneously), or the controller may control each chip 8310 individually, or the controller may control a combination of chips 8310 together.

Figure 38:
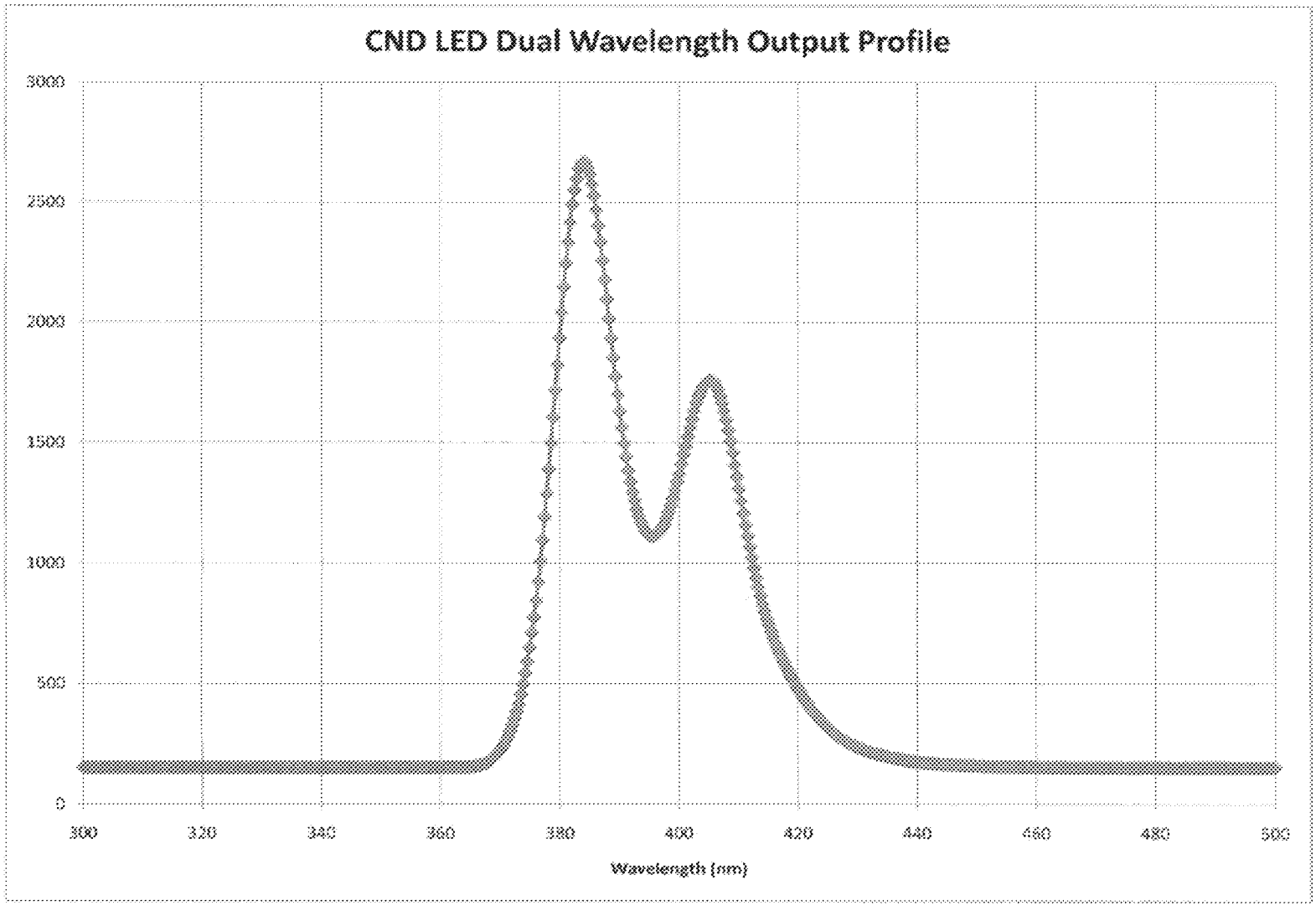
FIG. 38 shows an intensity output vs. wavelength profile for an LED device according to a particular embodiment.

FIG. 38 depicts the relative peak intensity wavelength profile of a multiple-wavelength LED device. As shown, a first peak intensity at a wavelength of approximately 385 nm is relatively higher than a second peak intensity at a wavelength of approximately 405 nm.

In another embodiment, the aforementioned light sources, particularly light sources 6050, 7050, and 8050, may be pulsable in accordance with a pulsing sequence. Pulsing may be used with a single wavelength LED device or a multiple-wavelength LED device. In a nail lamp that includes a plurality of light sources, with each including either a single LED device or a plurality of LED devices, the LED device(s) may all be pulsed simultaneously, or the LED devices may each be individually pulsed according to a different sequence. The example embodiments presented below describe a plurality of light sources each including a single LED device, but it should be understood that other types of light sources may be used.

In one embodiment, the light sources are pulsable between a first intensity and a second intensity. The first intensity may be a peak intensity (100%), or an intensity lower than a peak intensity, and the second intensity may be no intensity, or something higher than no intensity but lower than the first intensity. For example, the first intensity may be 90-100% of a maximum intensity. As another example, the first intensity may be 90-100% of a maximum intensity and the second intensity may be 40-60% of a maximum intensity. The LED devices useable in the embodiments described herein typically have an intensity range between 0 microwatts/cm$^2$ and 600 microwatts/cm$^2$. So, for example, the light sources may be pulsable between 600 microwatts/cm$^2$ and 0 microwatts/cm$^2$, pulsable between 500 microwatts/cm$^2$ and 200 microwatts/cm$^2$, or pulsable between any other intensities (e.g., 600 microwatts/cm$^2$ and 500 microwatts/cm$^2$, 400 microwatts/cm$^2$ and 200 microwatts/cm$^2$, 300 microwatts/cm$^2$ and 0 microwatts/cm$^2$, etc.).

The light sources may be pulsable between the first intensity and the second intensity according to a predetermined sequence. The controller may be used to adjust the intensities from the first intensity, after a predetermined amount of time, to the second intensity, and then stay at the second intensity for a predetermined amount of time. For example, the controller may be used to have the light sources emit at a peak intensity for a period of time between 0.01 and 5.0 seconds, and have the light sources emit at zero intensity (i.e., turn the light sources off) for a period of time between 0.01 and 10.0 seconds. It should be understood that the period of time for the first intensity and the second intensity may be of the same duration or of different durations.

The light sources may be pulsed for a single sequence (i.e., between a first and second intensity for the predetermined amount of time), or may be repeatedly pulsed according to the sequence for a predetermined amount of time or number of cycles. For example, the controller may be used to have the light sources emit at an intensity of 600 microwatts/cm$^2$ for 5.0 seconds (i.e., time period from 0.0 to 5.0 seconds), turn the light sources off for 10.0 seconds (i.e., time period 5.0-15.0 seconds), and repeat this cycle for a time period of 60.0 seconds. Again, while the time durations mentioned above are 5.0 seconds and 10.0 seconds, respectively, these time durations are merely examples. Other duration values may be used.

Examples of pulsing sequences will now be described. In a first example, the light source is pulsable according to the following pulsing sequence: the light source is first operated at a first intensity that is 40-60% of a maximum intensity for a first duration of 0.01 to 5.0 seconds, and is then operated at a second intensity of 0% ("zero intensity") for a second duration of 0.01 to 10.0 seconds. This pulsing sequence is repeated for a duration of 60.0 seconds.

In another example, the light source is pulsable according to the following pulsing sequence: the light source is first operated at a first intensity that is 40-60% of a maximum intensity for a first duration of 0.5 to 2.0 seconds, and is then operated at a second intensity of 0% ("zero intensity") for a second duration of 0.5 to 5.0 seconds. This pulsing sequence is repeated for a duration of approximately 4.0 to 20.0 seconds.

In another example, the light source is pulsable according to the following pulsing sequence: the light source is first operated at a first intensity that is 40-60% of a maximum intensity for a first duration of 0.01 to 5.0 seconds, and is then operated at a second intensity that is 90-100% of the maximum intensity for a second duration of 0.01 to 10.0 seconds. This pulsing sequence is repeated for a duration of 60.0 seconds.

In another example, the light source is pulsable according to the following pulsing sequence: the light source is first operated at a first intensity that is 40-60% of a maximum intensity for a first duration of 0.5 to 2.0 seconds, and is then operated at a second intensity that is 90-100% of the maximum intensity for a second duration of 0.5 to 5.0 seconds. This pulsing sequence is repeated for a duration of approximately 4.0 to 20.0 seconds.

In another example, the light source is pulsable according to the following pulsing sequence: the light source is first operated at a first intensity that is 90-100% of a maximum intensity for a first duration of 0.01 to 5.0 seconds, and is then operated at a second intensity of 0% ("zero intensity") for a second duration of 0.01 to 10.0 seconds. This pulsing sequence is repeated for a duration of 60.0 seconds.

In another example, the light source is pulsable according to the following pulsing sequence: the light source is first operated at a first intensity that is 90-100% of a maximum intensity for a first duration of 0.5 to 2.0 seconds, and is then operated at a second intensity of 0% ("zero intensity") for a second duration of 0.5 to 5.0 seconds. This pulsing sequence is repeated for a duration of approximately 4.0 to 20.0 seconds.

In another example, the light source is pulsable according to the following pulsing sequence: the light source is first operated at a first intensity that is 90-100% of a maximum intensity for a first duration of 0.01 to 5.0 seconds, and is then operated at a second intensity of 40-60% of the maximum intensity for a second duration of 0.01 to 10.0 seconds. This pulsing sequence is repeated for a duration of 60.0 seconds.

In another example, the light source is pulsable according to the following pulsing sequence: the light source is first operated at a first intensity that is 90-100% of a maximum intensity for a first duration of 0.5 to 2.0 seconds, and is then operated at a second intensity of 40-60% of the maximum intensity for a second duration of 0.5 to 5.0 seconds. This pulsing sequence is repeated for a duration of approximately 4.0 to 20.0 seconds.

While just described in terms of a first and second intensity, it should be understood that any number of intensities can be used in the sequence. For example, the light sources may be emitted at an intensity of 600 microwatts/cm$^2$ for 5.0 seconds, emitted at an intensity of 0 microwatts/cm$^2$ for 10.0 seconds, emitted at an intensity of 400 microwatts/cm$^2$ for 3.0 seconds, etc.

An example of a pulsing sequence with three intensities will now be described. In this example, the light source is pulsable according to the following pulsing sequence: the light source is first operated at a first intensity that is 40-60% of a maximum intensity for a first duration of approximately 1.0 second, is then operated at a second intensity of 0% ("zero intensity") for a second duration of approximately 1.0 second, and then operated at a third intensity that is 90-100% of a maximum intensity for a third duration of approximately 50.0 seconds. This pulsing sequence is repeated for a duration of approximately 60 seconds.

Furthermore, it should be understood that after repeating the any of the above pulsing sequences, the light source may be controlled to operate continuously at one of the first, second, or third intensities for a predetermined amount of time. Alternatively, rather than repeating the sequence, the light sources may remain at a certain intensity after the sequence until the controller turns off the light sources.

In an example of a pulsing sequence containing two intensities, the duration of the first intensity is from 0.5 seconds to 2.0 seconds, the duration of the second intensity is from 0.5 to 5.0 seconds, and the length of time of the sequence is from 4.0-20.0 seconds. After the sequence, the light sources emit continuously for a total time period, including the pulsing sequence, of 60.0 seconds.

As mentioned above, the controller above may be coupled to a plurality of control buttons, control dials, digital input pads, and the like, located on the base or other location of the nail lamp. These control buttons, dials, etc., may be used to alter the intensities at which the light sources emit, as well as to control the pulsing sequences just described. The table below depicts examples of values for the control buttons used to adjust the intensity emissions of the lights sources as well as the pulsing sequences.

| Current Setting | Relative Intensity (%) | Button 1 | Button 2 | Button 3 | Button 4 |
|---|---|---|---|---|---|
| 0.25 A | 48 | 10 second pulsing (1 sec. on, 1 sec. off) | 10 second pulsing (1 sec. on, 1 sec. off); 50 seconds continuous | | 10 second pulsing (1 sec. on, 1 sec. off) |
| 0.50 A | 96 | | | 60 seconds continuous | |
| 0.52 A | 100 | | | | 50 seconds continuous |

As shown in the table above, Button 1 is used for a lower than peak intensity and for a 10 second pulsing sequence with no continuous lighting after the pulsing sequence. When this button is used, the light sources will emit at 48% of peak intensity for 1.0 second, emit at 0 intensity for 1.0 second (i.e., the light sources are turned off), and repeat for a total duration of 10.0 seconds (i.e., 5 cycles). While this particular Button 1 shows a 10 second pulsing sequence with equal first intensity (48%) and second intensity (0%) time durations (i.e., 1 second on and 1 second off), it should be understood that Button 1 may alternatively have different durations for each of the intensities. Additionally, Button 1 may be any duration pulsing sequence, and is not limited to a 10 second pulsing sequence. For example, Button 1 may be a 20 second pulsing sequence with the light sources emitting at 48% of peak intensity for 2.0 seconds, emitting at 0 intensity for 1.0 second, and repeating this sequence. Furthermore, while described in terms of a percentage intensity and no intensity, Button 1 may alternatively be pulsed between two intensities (e.g., 48% and 100%).

Button 2 is used for a lower than peak intensity for a 10 second pulsing sequence followed by a duration of continuous lighting at the same intensity. Button 3 is used for a lower than peak intensity for a continuous amount of time with no pulsing. Button 4 pulses the light sources for a 10.0 second sequence at a first intensity, and then turns the light sources on at a peak intensity for a continuous amount of time. As with Button 1, the values in the above table are exemplary only and should not be so limited. Also, while described in terms of Buttons 1-4, it should be understood that any number of buttons may be used and each combination of pulsing sequences and emission intensities may correspond to an individual button. Furthermore, as explained above, control dials, input pads, etc., may be used instead of the control buttons just described In another embodiment, the controller may be used to alter the intensity at which one of the chips within the light source emits without altering the other chips. For example, the controller may reduce the reduce the current to the first chip to cause it to emit at an intensity less than peak intensity (i.e., less than 100%) while providing full current to the remaining chip(s) to cause them to emit at peak intensity (i.e., 100%).

Figure 39:
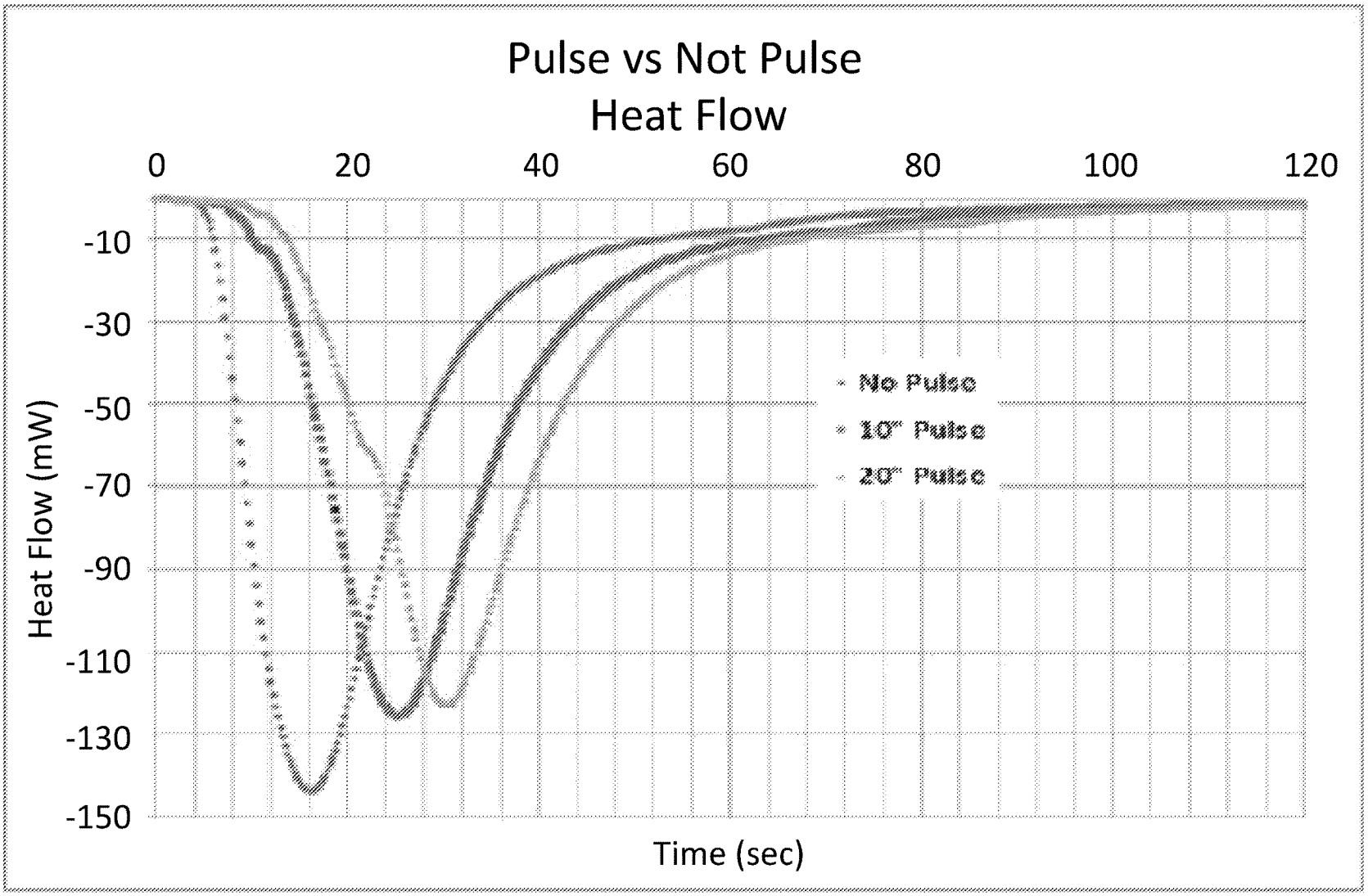
FIG. 39 shows a heat flow vs. time graph according to a particular embodiment.
Figure 40:
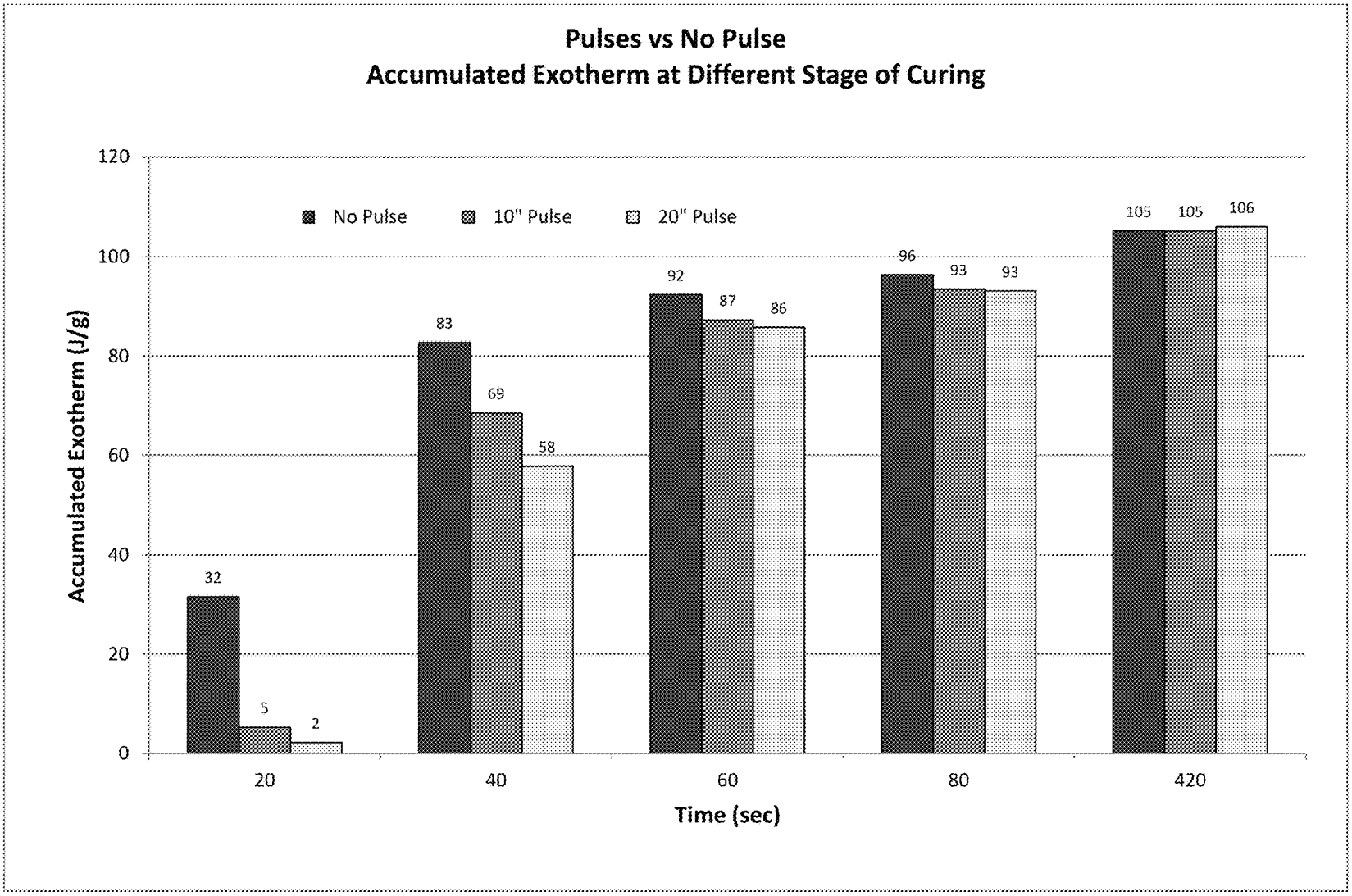
FIG. 40 shows an accumulated exotherm vs. time graph according to a particular embodiment.

FIGS. 39-40 show heat flow vs. time and accumulated exotherm vs. time, respectively, for light sources having no pulsing sequence, a 10 second pulsing sequence (pulsing 1.0 second on and 1.0 second off for 10.0 seconds), and a 20 second pulsing sequence (pulsing 1.0 second on and 1.0 second off for 20.0 seconds). All three samples have 60 seconds of continuous lighting after the pulse durations. As shown in FIG. 39, a no pulse sequence has a relatively high heat flow compared to the 10 second pulsing sequence and the 20 second pulse sequence. Additionally, this relatively high heat flow occurs at a time period before the peak heat flows of both the 10 second pulsing sequence and the 20 second pulsing sequence. After a 60.0 second period, the three sequences have approximate heat flow values. FIG. 40 shows the no pulse sequence resulting in a relatively high accumulated exotherm at earlier times, while the 10 second pulsing sequence and 20 second pulsing sequence result in a significantly lower accumulated exotherm at initial stages of the curing process. However, after a 60.0 second period, the three sequences have approximate accumulated exotherm values, and by 420 seconds, the accumulated exotherm is almost identical for all three sequences.

FIGS. 39-40 show that, overall, pulse sequences delay the peak time at which peak heat flow occurs, reduce the peak value of heat flow, reduce the accumulated exotherm during the periods of lighting, and result in the same total exotherm as the no pulse sequence. This pulsing sequence may be designed to efficiently cure nail product while avoiding heat-induced discomfort, or burns, to the user.

The foregoing illustrated embodiments are provided to illustrate the structural and functional principles of the present invention and are not intended to be limiting. To the contrary, the principles of the present invention are intended to encompass any and all changes, alterations and/or substitutions within the spirit and scope of the following claims. For example, any feature(s) of one of the lamps 10, 1010, 2010, 3010, 4010, 5010, 6010, 7010, and any feature(s) in the 8000 range, may be incorporated into any of the other lamps 10, 1010, 2010, 3010, 4010, 5010, 6010, 7010 without deviating from the scope of the present invention.

This application incorporates by reference in their entirety U.S. application Ser. No. 13/827,389 filed on Mar. 14, 2013, U.S. Provisional Application No. 62/059,585 filed on Oct. 3, 2014, and U.S. Provisional Application No. 62/058,865 filed on Oct. 2, 2014.

What is claimed is:

1. A nail lamp comprising:

a support; and a plurality of light sources disposed on the support, wherein each light source is structured to produce light to cure a light-curable nail product and each light source includes a plurality of semiconductor LEDs on a single circuit board, with at least one of the semiconductor LEDs having a peak electromagnetic emission intensity at a first wavelength in a range from about 365 nm to about 425 nm, and with at least one other of the semiconductor LEDs having a peak electromagnetic emission intensity at a second wavelength in a range from about 365 nm to about 425 nm, the second wavelength being different from the first wavelength; and a controller coupled to the light sources, wherein the each light source is pulsable between a first intensity and a second intensity, and wherein the controller is configured to control automatic pulsing of each light source between the first intensity and the second intensity.

2. The nail lamp according to claim 1, wherein the first wavelength is in a range from about 365 nm to about 385 nm, and wherein the second wavelength is in a range from about 395 to about 425 nm.

3. The nail lamp according to claim 1, wherein the first wavelength is in a range from about 380 nm to about 390 nm, and wherein the second wavelength is in a range from about 395 to about 425 nm.

4. A nail lamp comprising:

a support;

a space located below the support, the space configured for a user to insert at least a single nail;

two or more arrays of light sources mounted on the support including;

a first array of light sources oriented to direct light downward onto the at least a single nail and including a first plurality semiconductor chips, wherein;

at least one of the first plurality of semiconductor chips has a peak electromagnetic emission intensity at a first wavelength in a range from 360 nm to 440 nm, at least one other of the first plurality of semiconductor chips has a peak electromagnetic emission intensity at a second wavelength in a range from 360 nm to 475 nm, the second wavelength being different from the first wavelength and;

a second array of light sources oriented to direct light onto the at least a single nail, said second array of light sources oriented at an angle relative to the first array of light sources and including a second plurality of semiconductor chips, wherein;

at least one of the second plurality of semiconductor chips has a peak electromagnetic emission intensity at a third wavelength in a range from 360 nm to 475 nm, and with at least one other of the second plurality of semiconductor chips has a peak electromagnetic emission intensity at a fourth wavelength in a range from 360 nm to 440 nm, the fourth wavelength being different from the third wavelength.

5. The nail lamp of claim 4, wherein the first and third wavelengths are in the range from 360 nm to 390 nm and, the second and fourth wavelengths are in the range from 400 nm to 430 nm.

6. The nail lamp of claim 4 wherein, the first wavelength is equal to the third wavelength and the second wavelength is equal to the fourth wavelength.

7. The nail lamp of claim 4 wherein, the second array is at an angle of about 45 degrees relative to the first array.

8. The nail lamp of claim 4 wherein, the second array is at an angle of about 60 degrees relative to the first array.

9. The nail lamp of claim 4 further comprising, a third array of light sources oriented to direct light onto the at least a single nail and, said third array of light sources oriented at an angle relative to both the first array of light sources and the second array of light sources and, said third array of light sources including a third plurality of semiconductor chips wherein;

at least one of the semiconductor chips has a peak electromagnetic emission intensity at a fifth wavelength in a range from 360 nm to 440 nm, and at least one other of the semiconductor chips has a peak electromagnetic emission intensity at a sixth wavelength in a range from 360 nm to 475 nm, the sixth wavelength being different from the fifth wavelength.

10. The nail lamp of claim 9 wherein the fifth wavelength is in the range from 360 nm to 390 nm and the sixth wavelength is in the range from 400 nm to 430 nm.

11. The nail lamp of claim 4 wherein the space is configured for a user to insert at least five nails of a hand or a foot.

12. The nail lamp of claim 4 wherein the second array of light sources is oriented to direct light onto a thumb of either a left hand or a right hand of a user.

13. The nail lamp of claim 9 wherein the third array of light sources is oriented to direct light onto a thumb of the other of the left hand or the right hand of a user.

14. The nail lamp of claim 4 wherein the light of the first wavelength in combination with the light of the second wavelength cures a light curable nail product more rapidly than the light of only the first wavelength or the light of only the second wavelength.

15. The nail lamp of claim 4 wherein the light of the third wavelength in combination with the light of the fourth wavelength cures a light curable nail product more rapidly than the light of only the third wavelength or the light of only the fourth wavelength.

16. The nail lamp of claim 9 wherein the light of the fifth wavelength in combination with the light of the sixth wavelength is able to cure a light curable nail product more rapidly than the light of only the fifth wavelength or the light of only the sixth wavelength.

17. The nail lamp of claim 4 wherein the space is open to the ambient environment at both the front and the rear of the space.

* * * * *